US012318014B2

(12) United States Patent
Caron et al.

(10) Patent No.: US 12,318,014 B2
(45) Date of Patent: Jun. 3, 2025

(54) ENCAPSULATED SPRING FOR CUSHION

(71) Applicant: TRICA INC., Saint-Jérôme (CA)

(72) Inventors: François Caron, Lorraine (CA); Philippe Beland, Montreal (CA)

(73) Assignee: TRICA INC., Saint-Jerome (CA)

( * ) Notice: Subject to any disclaimer, the term of this patent is extended or adjusted under 35 U.S.C. 154(b) by 130 days.

(21) Appl. No.: 18/112,652

(22) Filed: Feb. 22, 2023

(65) Prior Publication Data

US 2023/0200555 A1 Jun. 29, 2023

Related U.S. Application Data

(63) Continuation-in-part of application No. 17/492,096, filed on Oct. 1, 2021, now Pat. No. 11,612,253.

(60) Provisional application No. 63/086,150, filed on Oct. 1, 2020.

(51) Int. Cl.

| | |
|---|---|
| ***A47C 4/02*** | (2006.01) |
| ***A47C 7/02*** | (2006.01) |
| ***A47C 7/30*** | (2006.01) |
| ***A47C 13/00*** | (2006.01) |
| ***A47C 31/02*** | (2006.01) |

(52) U.S. Cl.

CPC ..... *A47C 31/023* (2013.01); *A47C 4/02* (2013.01); *A47C 7/028* (2013.01); *A47C 7/30* (2013.01); *A47C 13/005* (2013.01)

(58) Field of Classification Search

CPC .. A47C 4/02; A47C 7/028; A47C 7/30; A47C 13/005

USPC ..... 297/440.1, 440.14, 452.49, 452.52, 297/452.53, 452.63

See application file for complete search history.

(56) References Cited

U.S. PATENT DOCUMENTS

| | | | | | |
|---|---|---|---|---|---|
| 1,334,745 | A | * | 3/1920 | Farr | B68G 15/00 53/260 |
| 2,358,438 | A | * | 9/1944 | Beachley | A47C 7/028 29/91.1 |
| 2,638,606 | A | * | 5/1953 | Austin | A47C 23/063 5/247 |
| 3,370,306 | A | * | 2/1968 | Lovette | A47C 27/16 5/659 |
| 4,305,616 | A | * | 12/1981 | Martinez | A47C 4/028 297/440.1 X |
| 4,632,459 | A | * | 12/1986 | Herschlag | A47C 4/028 297/440.1 X |

(Continued)

*Primary Examiner* — Rodney B White

(74) *Attorney, Agent, or Firm* — Benoit&Cote Inc.; Charles-Andre Caron; Mathieu Audet

(57) ABSTRACT

A piece of furniture may include a structure having side walls and top walls adjoining the side walls. The piece of furniture may include a blade assembly to cover at least partially the structure, the blade assembly comprising: an envelope comprising a support portion and side panels, the support portion comprising a top layer, a bottom layer, and longitudinal sleeves extending between the top layer and the bottom from about a first one of the side panels to about a second one of the side panels, with the longitudinal sleeves being isolated from each other; and blades inserted in the longitudinal sleeves, wherein the side panels are mounted to the top layer, and wherein the side panels of the blade assembly are secured to the side walls of the structure with the side panels maintaining the bottom layer abutting the top walls.

15 Claims, 27 Drawing Sheets

(56) References Cited

U.S. PATENT DOCUMENTS

| | | | | | |
|---|---|---|---|---|---|
| 5,176,424 | A * | 1/1993 | Tobita | A47C 27/083 | 297/452.52 |
| 6,161,234 | A * | 12/2000 | Amann | A47C 23/06 | 5/241 |
| 8,651,579 | B2 * | 2/2014 | Pettingill | A47C 19/027 | 297/452.49 X |
| 9,078,527 | B2 * | 7/2015 | Pettingill | A47C 7/02 | |
| 9,241,578 | B1 * | 1/2016 | Franken | A47C 31/123 | |
| 10,136,736 | B2 * | 11/2018 | Franken | A47C 19/027 | |
| 11,882,939 | B2 * | 1/2024 | Gansow | A47C 31/02 | |
| 2007/0001504 | A1 * | 1/2007 | Mayer | A47C 7/22 | 297/440.1 |

* cited by examiner

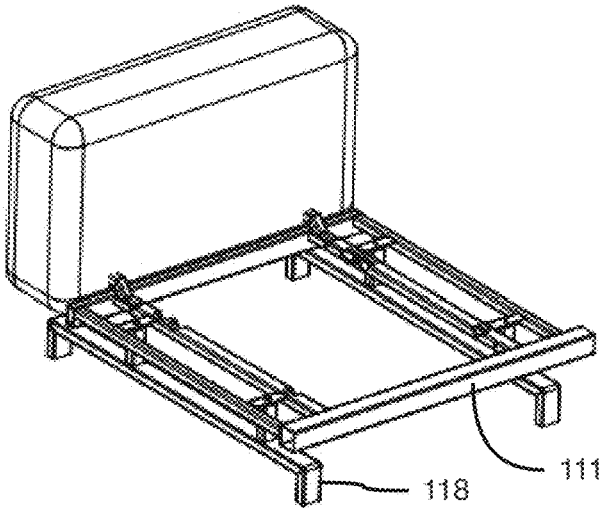
FIG. 26
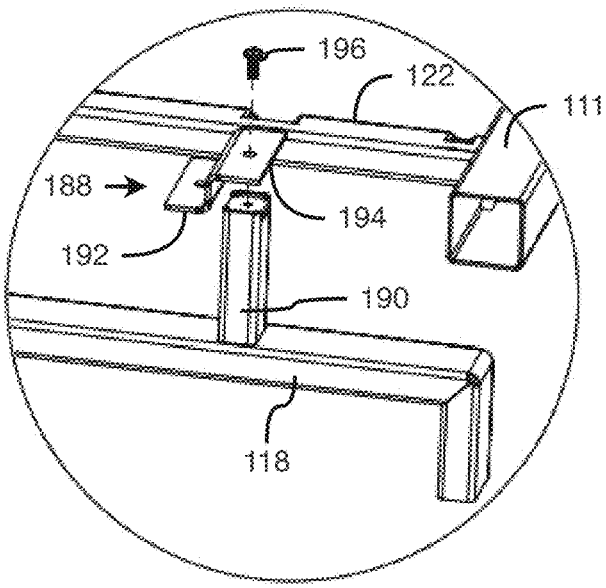
FIG. 27
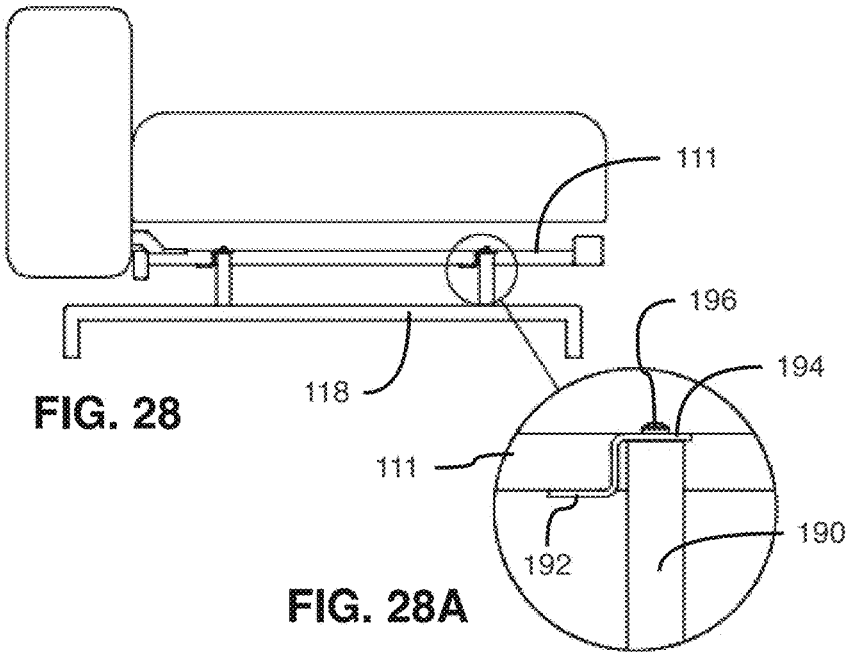
FIG. 28
FIG. 28A

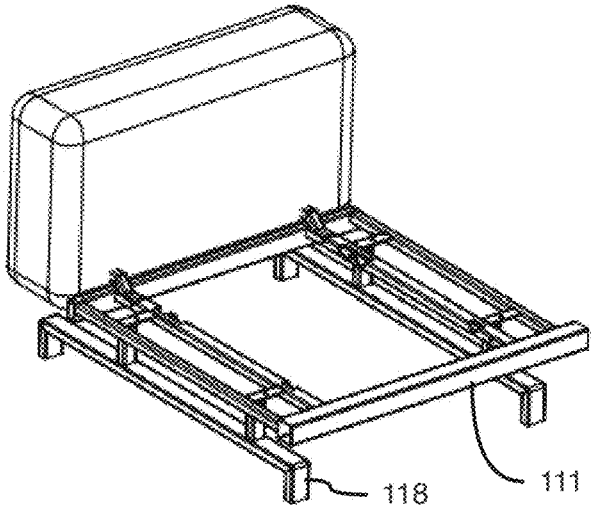
FIG. 29
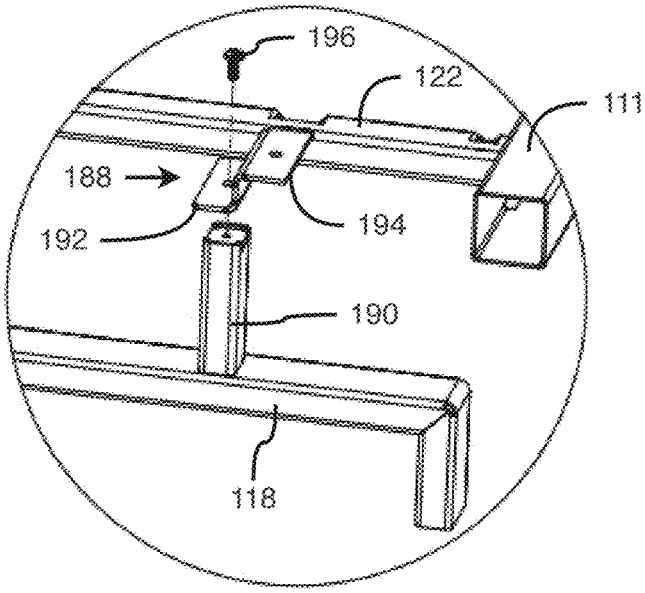
FIG. 30
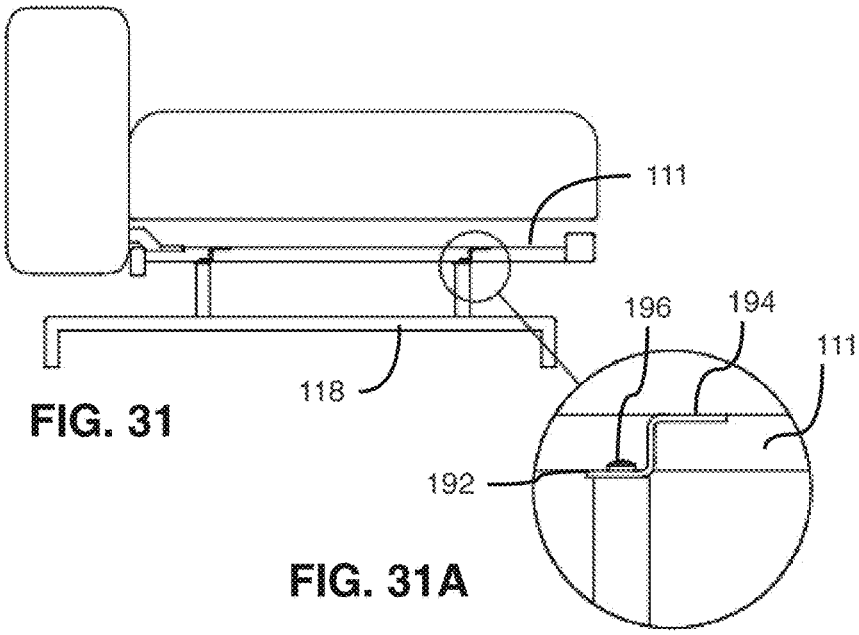
FIG. 31
FIG. 31A

ENCAPSULATED SPRING FOR CUSHION

CROSS-REFERENCE TO RELATED APPLICATION

This U.S. Patent Application relates to and is a continuation-in-part application claiming priority under 35 U.S.C. § 120 from U.S. patent application Ser. No. 17/492,096, filed Oct. 1, 2021, now U.S. Pat. No. 11,612,253 B2, under 35 U.S.C. § 111, entitled MODULAR SOFA WITH ADJUSTABLE SEAT, which relates to and is a non-Provisional Application claiming priority under 35 U.S.C. § 119 (e) from U.S. Provisional Pat. Application Ser. No. 63/086,150, filed Oct. 1, 2020, entitled MODULAR SOFA WITH ADJUSTABLE SEAT, the specifications of which are hereby incorporated herein by reference in their entireties.

BACKGROUND

(A) Field

The subject matter disclosed generally relates to furniture. More particularly, the subject matter disclosed relates to the structure of modular furniture such as sofas and chairs.

(b) Related Prior Art

In the field of furniture, there is a constant need for improvement and innovation to provide furniture with improved versatility, improved ease of assembly, improved quality and durability, and improved adaptability to the needs and preferences of the owners.

The present innovation pertains to these needs for improvement and innovations.

SUMMARY

In some aspects, the techniques described herein relate to a piece of furniture including: —a base including: —longitudinal structures; —a pair of first transversal structures mounted to the longitudinal structures; and —a first pair of arms each rotatably mounted to a respective one of the first transversal structures; —a seat cushion to be laid over the base; wherein the arms are movable between a first position and a second position, the first position and the second position providing therethrough one of: —an adjustable support for the seat cushion; and —an adjustable slope for the seat cushion.

In some aspects, the techniques described herein relate to a piece of furniture, wherein the first transversal structure has a top face, wherein the arms, when moved to the first position, extend above the top face of the first transversal structures, and wherein the arms, when moved to the second position, are below the top face of the first transversal structures.

In some aspects, the techniques described herein relate to a piece of furniture, further including: —a second pair of arms each rotatably mounted to a respective one of the first transversal structures; wherein the second pair of arms are movable between a third position and a fourth position, the third position and the fourth position providing, in combination with the first position and the second position, one of: —an additional adjustable support for the seat cushion; and —an additional adjustable slope for the seat cushion.

In some aspects, the techniques described herein relate to a piece of furniture, wherein the piece of furniture includes a pair of outer transversal structures mounted to the longitudinal structures, wherein the outer transversal structures are outward from and parallel to the first transversal structures.

In some aspects, the techniques described herein relate to a piece of furniture, wherein the arms are mounted to the first transversal structures through trunnions, and wherein the piece of furniture further includes a first pole mounted to the arms distant from the trunnions.

In some aspects, the techniques described herein relate to a piece of furniture comprising a first pole, wherein the first pole includes pole ends extending aside to the arms.

In some aspects, the techniques described herein relate to a piece of furniture comprising a first pole, wherein the first transversal structures have a top face, and wherein the first transversal structures provide at least two abutments for the first pole that are at different heights relative to the top face.

In some aspects, the techniques described herein relate to a piece of furniture comprising a first pole, wherein the longitudinal structures have respectively a front top face and a rear top face, defining a cushion-support plane together, and wherein the first pole in the first position provides a pole-top face extending about the cushion-support plane.

In some aspects, the techniques described herein relate to a piece of furniture comprising a first pole, wherein the first transversal structures each includes a first side and a second side, wherein the first sides are facing each other at a first distance from each other, wherein the second sides are facing away from each other and have a second distance in-between, and wherein the first pole has a length that is smaller than the second distance.

In some aspects, the techniques described herein relate to the preceding piece of furniture, wherein the length of the first pole is greater than the first distance.

In some aspects, the techniques described herein relate to a piece of furniture including: —a base including: —a frame; and —mounting brackets mounted inwardly to the frame, each one of the mounting brackets including a mounting rod; and —a cushion including: —a cushion body; and —a pair of mounting braces extending from the cushion body and having an extremity distant from the cushion body, the extremity of each of the mounting braces including a slit in which the rod is positioned as the cushion is rotated around the rod until the cushion stands in place substantially vertically.

In some aspects, the techniques described herein relate to a piece of furniture, wherein the mounting braces include a sloped abutment face to abut the frame once the cushion rotated in place.

In some aspects, the techniques described herein relate to the preceding piece of furniture, wherein the sloped abutment faces result in the mounting braces being pushed toward the mounting rods when the cushion is exerted a downward force.

In some aspects, the techniques described herein relate to a piece of furniture, wherein the mounting brace includes a bottom face abutting the mounting bracket once the cushion rotated in place.

In some aspects, the techniques described herein relate to a piece of furniture, further including securing means adapted to secure the mounting braces to the mounting brackets once the cushion rotated in place.

In some aspects, the techniques described herein relate to a piece of furniture, wherein the mounting braces have a rectangular brace profile and wherein the mounting brackets have a bracket profile of a rectangular shape having one open side, wherein the mounting brackets are adapted to inset the mounting braces.

In some aspects, the techniques described herein relate to a piece of furniture, wherein the mounting rod extends horizontally.

In some aspects, the techniques described herein relate to a piece of furniture including: —a base including: —a frame; and —mounting brackets mounted inwardly to the frame and each including a first mounting structure; and —a cushion including: —a cushion body; and —a pair of mounting braces extending from the cushion body, each including a second mounting structure complementary to the first mounting structure and an abutment face, wherein the complementary mounting structures are to interface with each other in a first position, and to remain interfaced when rotating the cushion until the abutment face of the mounting braces abuts one of the frame and the mounting bracket and the cushion stands substantially vertically.

In some aspects, the techniques described herein relate to a piece of furniture, wherein the mounting braces include a sloped abutment face to abut the frame once the cushion rotated in place.

In some aspects, the techniques described herein relate to a piece of furniture, wherein the mounting braces have a rectangular brace profile and wherein the mounting brackets have a bracket profile of a rectangular shape having one open side, wherein the mounting brackets are adapted to inset the mounting braces.

In some aspects, the techniques described herein relate to a piece of furniture including: a structure having side walls and top walls adjoining the side walls; and a blade assembly to cover at least partially the structure, the blade assembly including: an envelope including a support portion and side panels, the support portion including a top layer, a bottom layer, and longitudinal sleeves extending between the top layer and the bottom from about a first one of the side panels to about a second one of the side panels, with the longitudinal sleeves being isolated from each other; and blades inserted in the longitudinal sleeves; wherein the side panels are mounted to the top layer, and wherein the side panels of the blade assembly are secured to the side walls of the structure with the side panels maintaining the bottom layer abutting the top walls.

In some aspects, the techniques described herein relate to a piece of furniture, wherein at least one of the side panels is of the same piece of fabric as the top layer.

In some aspects, the techniques described herein relate to a piece of furniture, wherein the top layer and the bottom layer are made of the same type of fabric.

In some aspects, the techniques described herein relate to a piece of furniture, wherein securing means secure the top layer to the bottom layer.

In some aspects, the techniques described herein relate to a piece of furniture, wherein the securing means consists in sewing.

In some aspects, the techniques described herein relate to a piece of furniture, wherein the securing means consists in one of stappling, gluing, and fusing.

In some aspects, the techniques described herein relate to a piece of furniture, wherein the bottom layer is wider than the top layer, whereby having longitudinal sleeves domed downward.

In some aspects, the techniques described herein relate to a piece of furniture, wherein a single one of the side panels is secured to the top layer, on an open side of the longitudinal sleeves.

In some aspects, the techniques described herein relate to a piece of furniture, wherein the blades are made of a combination of plastic and fiberglass.

In some aspects, the techniques described herein relate to a piece of furniture, wherein the combination of plastic and fiberglass is extruded together to obtain the blades.

In some aspects, the techniques described herein relate to a piece of furniture, wherein each of the top walls abutted by the blades through the bottom layer has a length of at least 20 mm.

In some aspects, the techniques described herein relate to a piece of furniture, wherein the structure includes a support-free area extending between the top walls.

In some aspects, the techniques described herein relate to a piece of furniture, wherein the support-free area extends over at least 500 mm.

In some aspects, the techniques described herein relate to a piece of furniture, wherein the support-free area extends over at most 1100 mm.

In some aspects, the techniques described herein relate to a piece of furniture, wherein the blades have ends substantially aligned with each other and parallel to a near junction of the support portion and one of the side panels.

In some aspects, the techniques described herein relate to a method of making a piece of furniture including: making a structure having side walls and top walls adjoining the side walls; making an envelope including a support portion and side panels, the support portion including a top layer, a bottom layer, and longitudinal sleeves extending between the top layer and the bottom from about a first one of the side panels to about a second one of the side panels, with the longitudinal sleeves being isolated from each other; inserting blades in the sleeves; laying down the envelope on the structure with the blades through the bottom layer abutting the top walls; and securing the side panels to the structure.

In some aspects, the techniques described herein relate to a method of making a piece of furniture, wherein the step of making the envelope includes securing the top layer to the bottom layer over edges of the sleeves.

In some aspects, the techniques described herein relate to a method of making a piece of furniture, wherein the step of securing the side panels includes gluing the side panels over the side walls of the structure.

In some aspects, the techniques described herein relate to a method of making a piece of furniture, wherein the step of making the envelope includes keeping an opening to the sleeves to insert the blade therethrough in the sleeves.

In some aspects, the techniques described herein relate to a method of making a piece of furniture, wherein the step of making the envelope includes securing the side panels to the top layer.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which:

FIG. 26 is a perspective view of the frame mounted to the leg structures in a low position with a backrest cushion mounted thereto;

FIG. 27 is a closeup perspective view of the attachment of the frame to a leg structure when mounting in a low the position;

FIGS. 28 and 28A are respectively a side view and a closeup view according to designation 28A the frame mounted to the leg structures in a low position;

FIG. 29 is a perspective view of the frame mounted to the leg structures in a high position with a backrest cushion mounted thereto;

FIG. 30 is a closeup perspective of the attachment of the frame to a leg structure when mounting in the high position;

FIGS. 31 and 31A are respectively a side view and a closeup view according to designation 31A the frame mounted to the leg structures in a high position;

It will be noted that throughout the appended drawings, like features are identified by like reference numerals.

DETAILED DESCRIPTION

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

Figure 1:
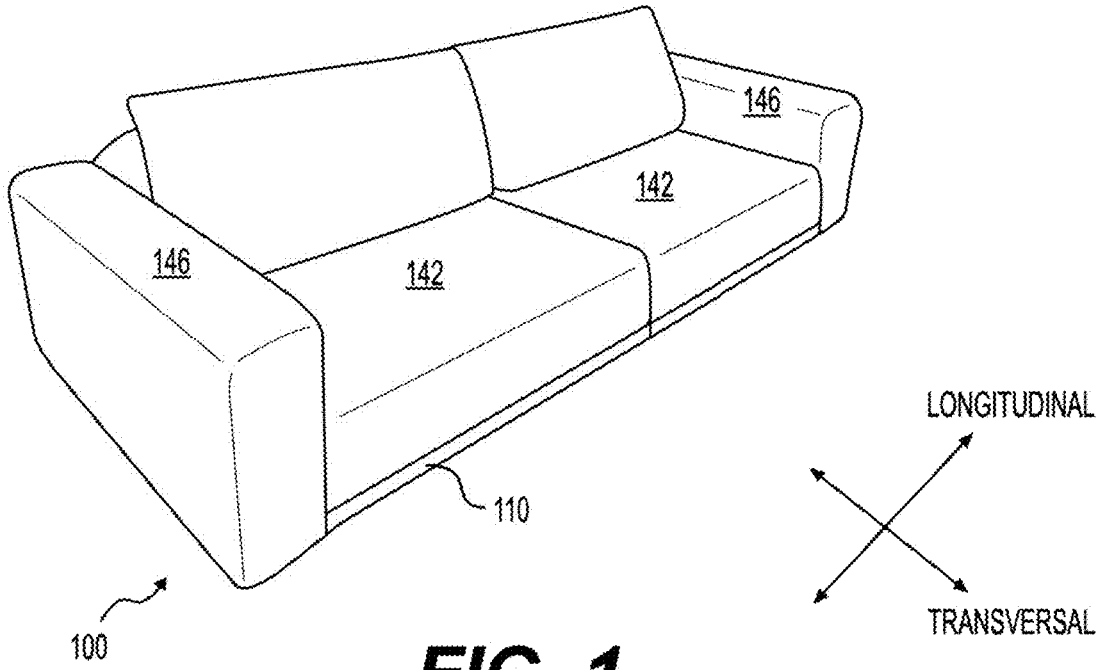
FIG. 1 is a picture showing a front perspective view of a sofa in accordance with an embodiment.

The terms "top", "up", "upper", "bottom", "lower", "down", "vertical", "horizontal", "interior" and "exterior" and the like are intended to be construed in their normal meaning in relation with normal installation of the product, with the normal orientation of the sofa 100 being provided on FIG. 1 with axes identifying the longitudinal and transversal orientations.

It should further be noted that for purposes of this disclosure, the terms "connected" and "coupled" mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature unless otherwise indicated herein.

In realizations, there are disclosed components of a seating furniture piece such as a modular sofa 100.

It will be noted that throughout the appended drawings, like features are identified by like reference numerals.

Figure 2:
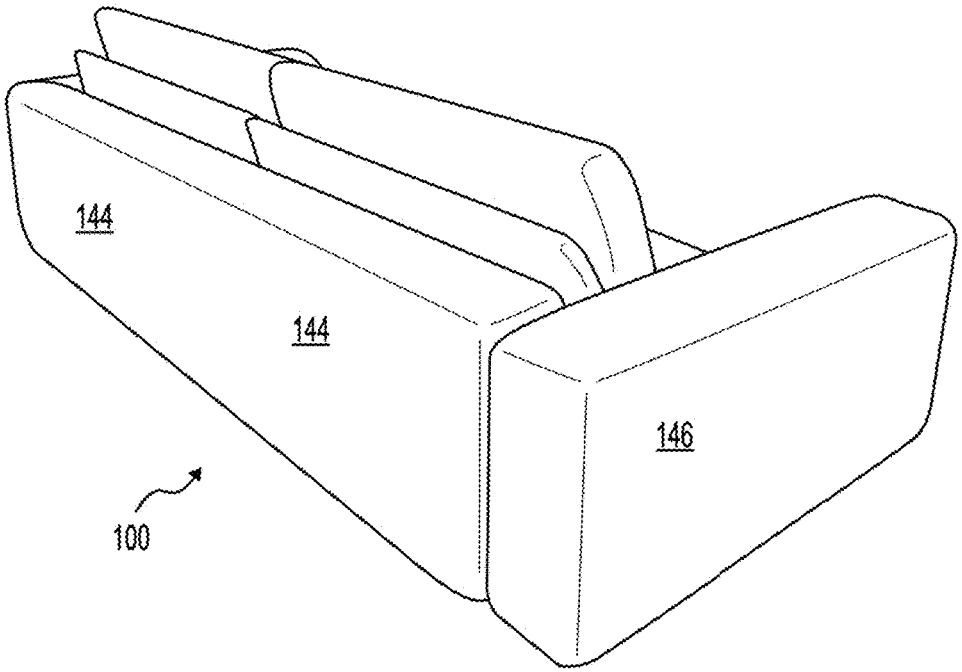
FIG. 2 is a picture showing a rear perspective view of the sofa of FIG. 1.

Referring now to the drawings, and more particularly to FIGS. 1 and 2, the sofa 100 comprises a base 110, seat cushions 142, backseat cushion 144, and armrest cushions 146.

The depicted sofa 100 is adapted to provide places for four (4) people and comprises two (2) seat cushions 142, two (2) backseat cushions 144, and two (2) armrest cushions 146. Further, the depicted sofa 100 is adapted to provide two (2) distinct adjustable areas as will be described hereinafter. However, many configurations are available without departing the scope of the present description.

Figure 3:
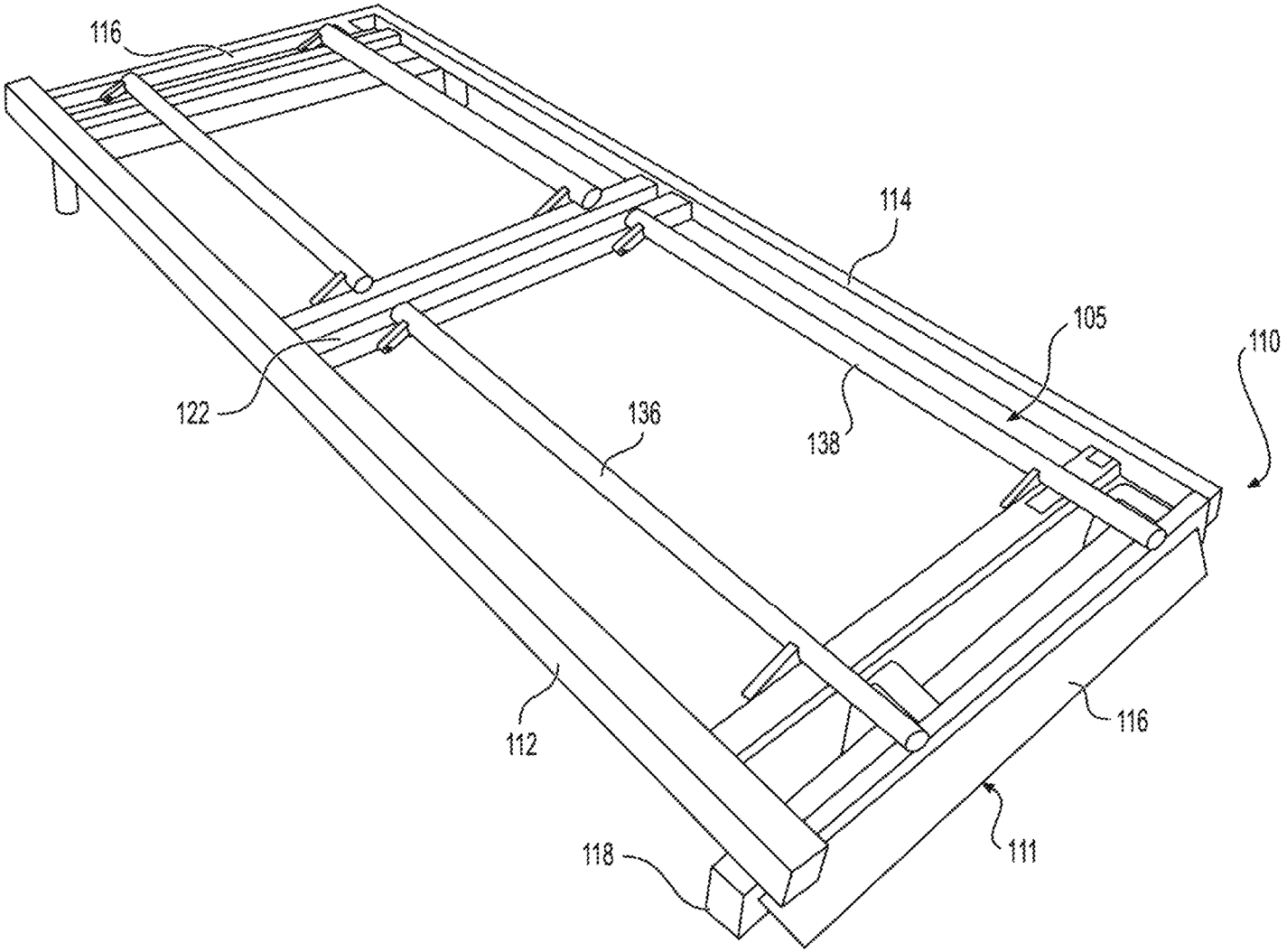
FIG. 3 is a picture showing a perspective view of the base of the sofa of FIG. 1.

Referring to FIG. 3, the base 110 comprises a frame 111 and complementary components on which the seat cushions 142 are laid down that define together a seating structure 105. The frame 111 comprises a front beam 112, a rear beam 114, aka two longitudinal structures, and two (2) side beams 116, aka two transversal structures. Mounted to the frame 111, and more particularly to the front beam 112 and the rear beam 114 are two (2) inner transversal structures 122 per adjustable area.

The sofa 100 comprises a pair of leg structures 118 typically mounted to both the side beams 116 of the frame 111 and to the external ones of the inner transversal structures 122 when two (2) leg structures 118 are used. According to realizations, when more than two (2) leg structures 118 are used, the additional leg structures 118 are mounted either to neighbor inner transversal structures 122, or alternatively to the front beam 112 and the rear beam 114.

Figure 6:
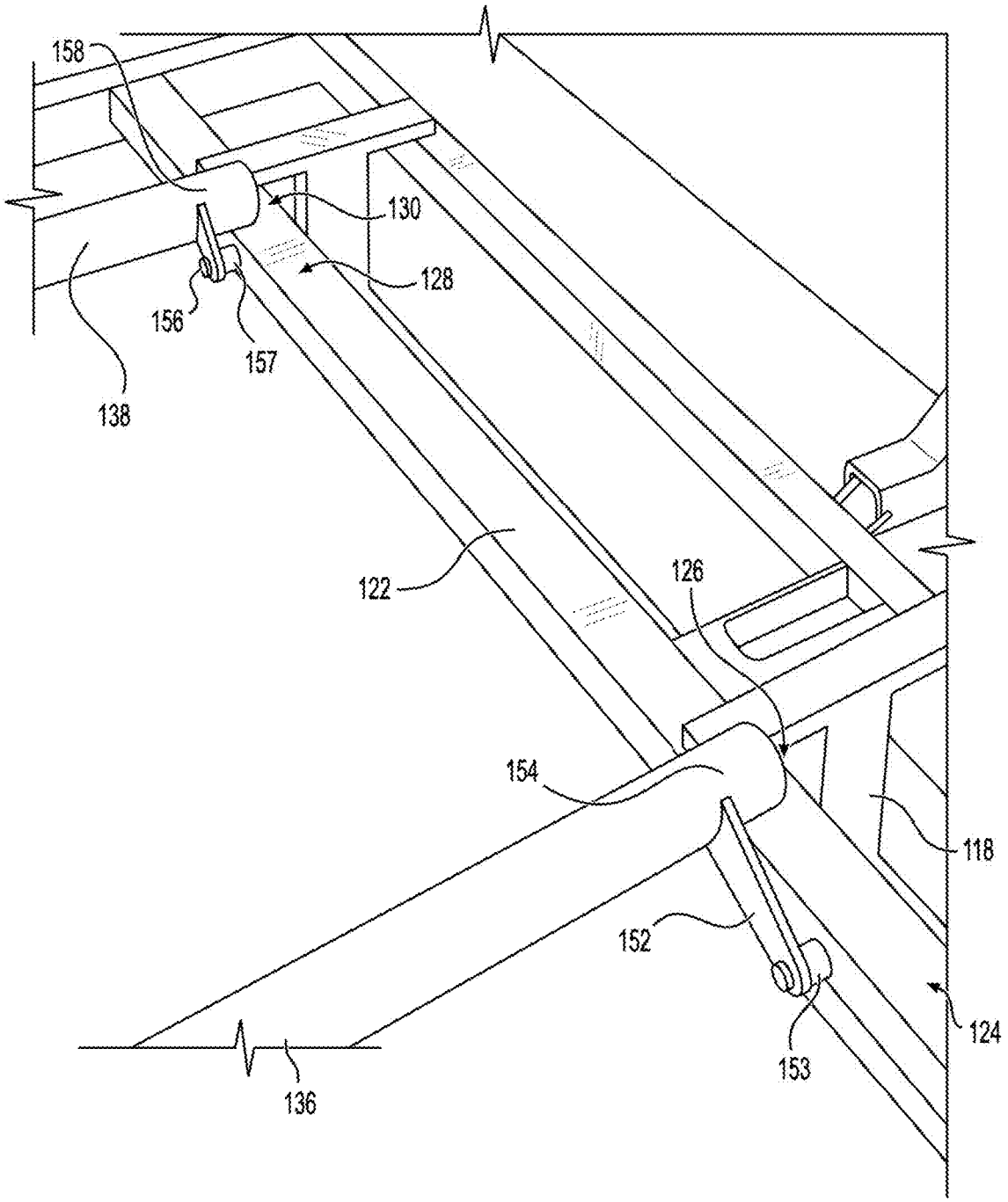
FIG. 6 is a picture showing a closeup perspective view of a portion of the base of FIG. 3.

Referring particularly to FIG. 6 and additionally to FIGS. 19 to 22, a front arm 152 and a rear arm 156 are rotatably mounted to each of the inner transversal structures 122. A front pole 136 comprises pole ends 154 mounted to the front arm 152. A rear pole 138 comprises the pole ends 158 mounted to the rear arm 156. The pole ends 154, 158 are distant from the trunnions 153, 157, allowing to pivot the arms 152, 156 between a first position and a second position.

Figure 21:
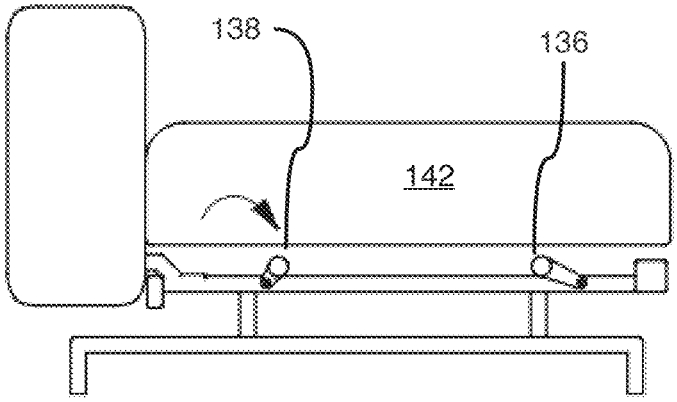
Figure 22:
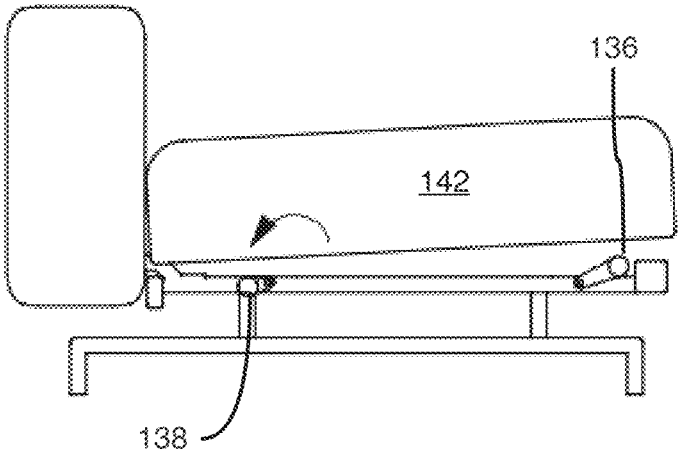
Figure 23:
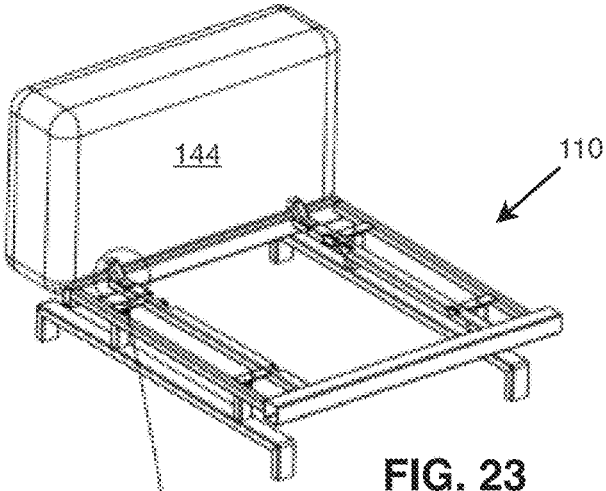
FIG. 23 is a schematic perspective view of the base of the sofa of FIG. 1 without poles mounted thereto, and a backrest cushion mounted thereto.
Figure 23A:
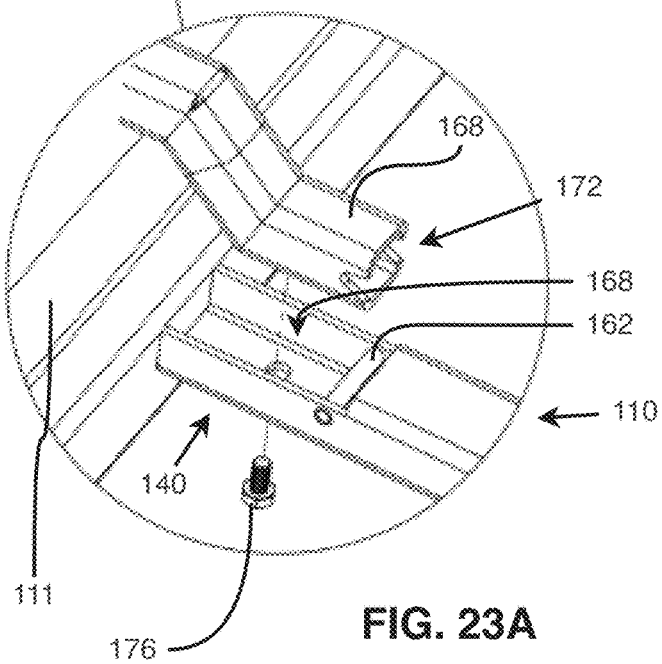
FIG. 23A is a close-up view of the attachment of the of the backrest cushion to the base along the identified portion 23A on FIG. 23.
Figure 24:
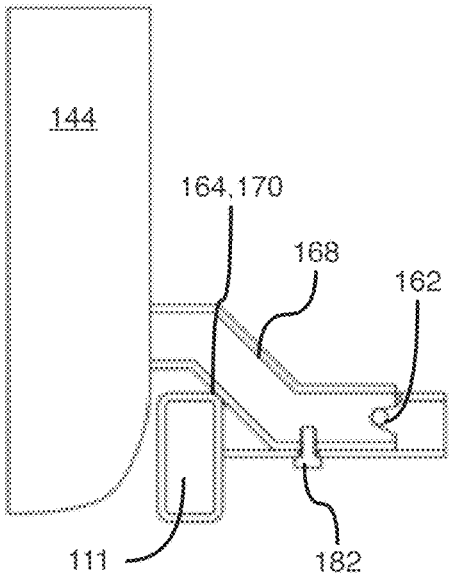
FIG. 24 is a schematic side view of the backrest cushion mounted and secured to the base.

The poles 136, 138 are adapted to sit on abutments, namely a first front abutment 124 corresponding to a first position of the front pole 136 (as depicted on FIGS. 19 and 22); a second front abutment 126 corresponding to a second position of the front pole 136 (as depicted on FIGS. 20 and 21); a first rear abutment 128 corresponding to a second position of the rear pole 138 (as depicted on FIGS. 19 and 20); and a second rear abutment 130 corresponding to a second position of the rear pole 138 (as depicted on FIGS. 21 and 22).

The poles 136, 138 further extend over the range between their respective supporting arms 152, 156, wherein the portion of the pole 136, 138 extending beyond the arms 152, 156 are designed to contact the abutments 124, 126, 128 and 130.

According to a preferred realization, at least one of the front abutments 124 and 126 has a concave shape inset in the inner transversal structures 122. The concave shape is adapted to receive at least a portion of the front pole 136, resulting in the seat cushion 142, when the front pole 136 is abutting that concave-shaped abutment, abutting only the top face of the inner transversal structures 122 or both the top face of the inner transversal structures 122 and the pole extending in-between. With the poles 136 and 138 having front and rear abutments that may be at different heights, the two available positions of each pole 136, 138 may provide up to four distinct slopes/heights, based on the selected abutments 124, 126, 128, 130. Based on presence of additional abutments structures, see exemplary frontmost abutment 178 and rearmost abutment 180 on FIGS. 19 to 22 and the seat cushion 142 abutting on the frontmost abutment 178/rearmost abutment 180 or the front pole 136/rear pole 138, selection of positions of the poles 136, 138 may result solely in a selection of the slope of the seat cushion 142 and/or a selection of firmness of the seat cushion as it is described herein after.

According to a realization, at least one of the abutments 124, 126 is high enough for the seat cushion 142 to contact the front pole 136 when laid in its position (ready for seating), and thus providing a support that is rear to the front beam 112 of the frame 111 when the seat cushion 142 is in place.

It should be noted that having the front pole 136 providing a support that is rear from the front beam 112 shortens the range over which the blades 149 (see FIGS. 7 to 9) of the seat cushions 142 are free of support, thus providing firmer support to the seat cushion 142 and hence to the person sitting on it.

Figure 7:
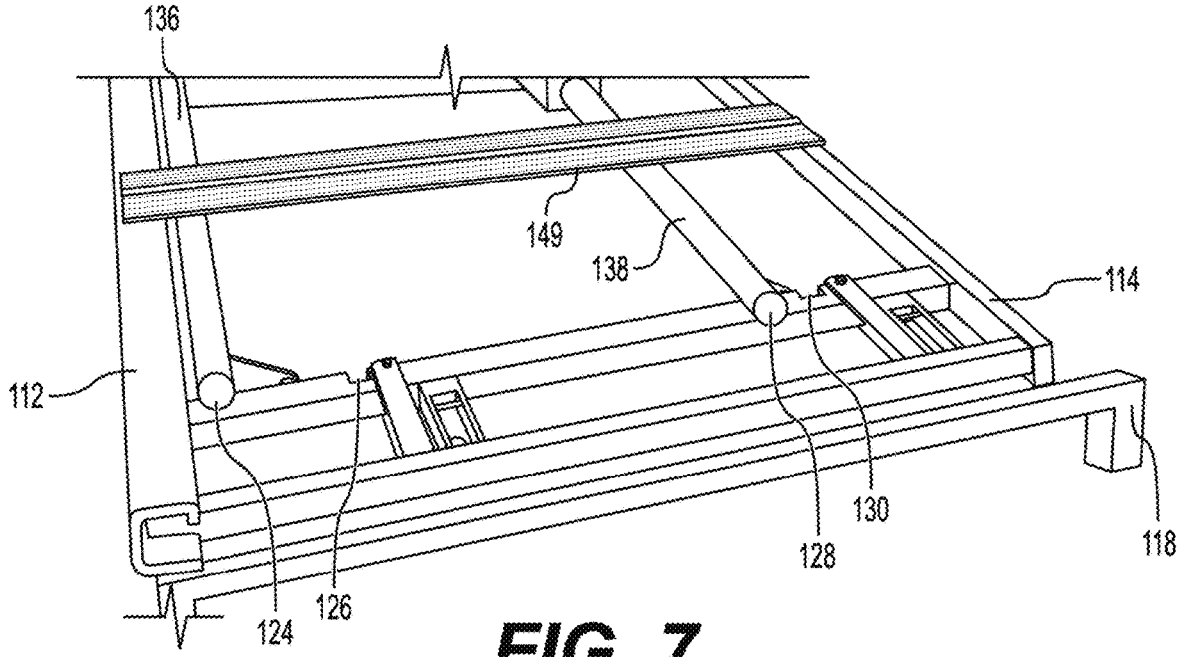
FIG. 7 is a picture showing a closeup perspective view of the portion of the seating structure according to FIG. 3 with the front pole and the rear pole respectively in their first position.
Figure 8:
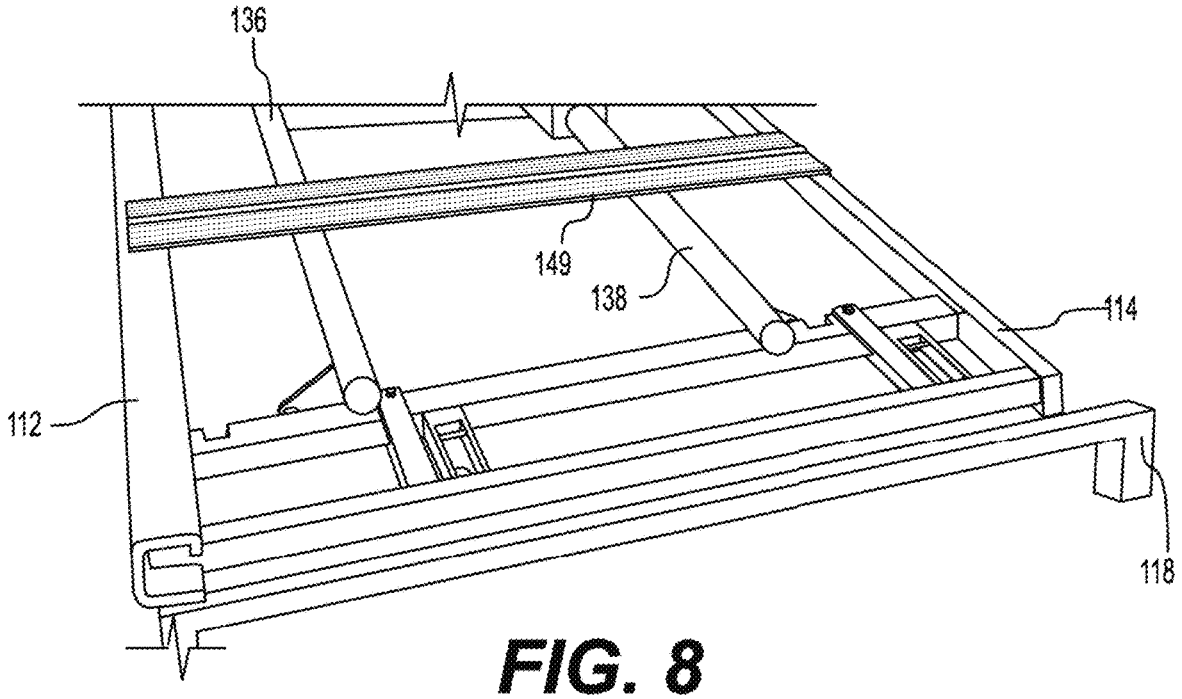
FIG. 8 is a picture showing the closeup perspective view of the portion of the seating structure according to FIG. 3 with the front pole in its second position and the rear pole respectively in its first position.
Figure 9:
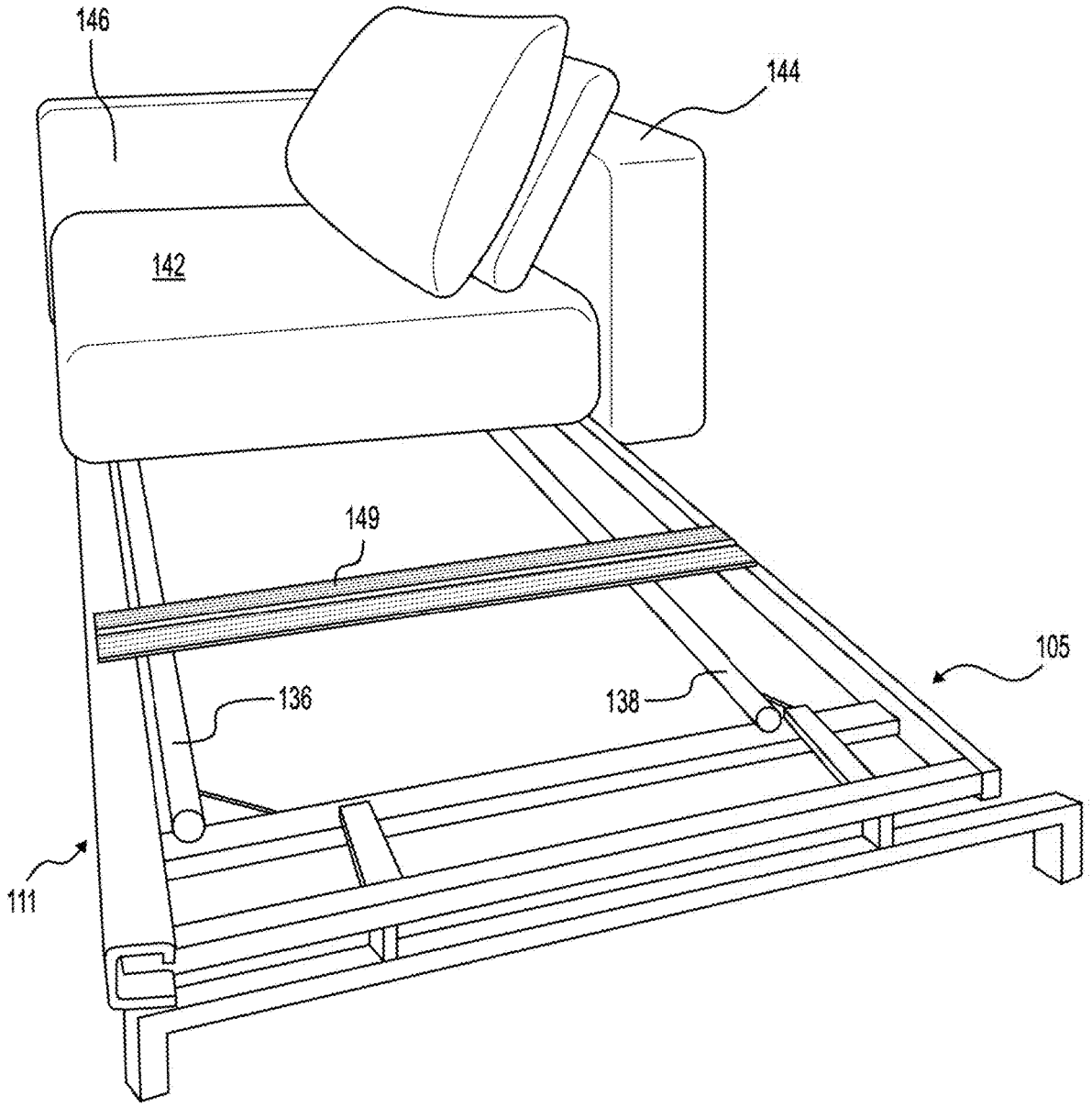
FIG. 9 is a picture showing a view of the seating structure of FIGS. 6 and 7 with a blade of a seat cushion depicted alone outside of the seat cushion and laid thereover.
Figure 10:
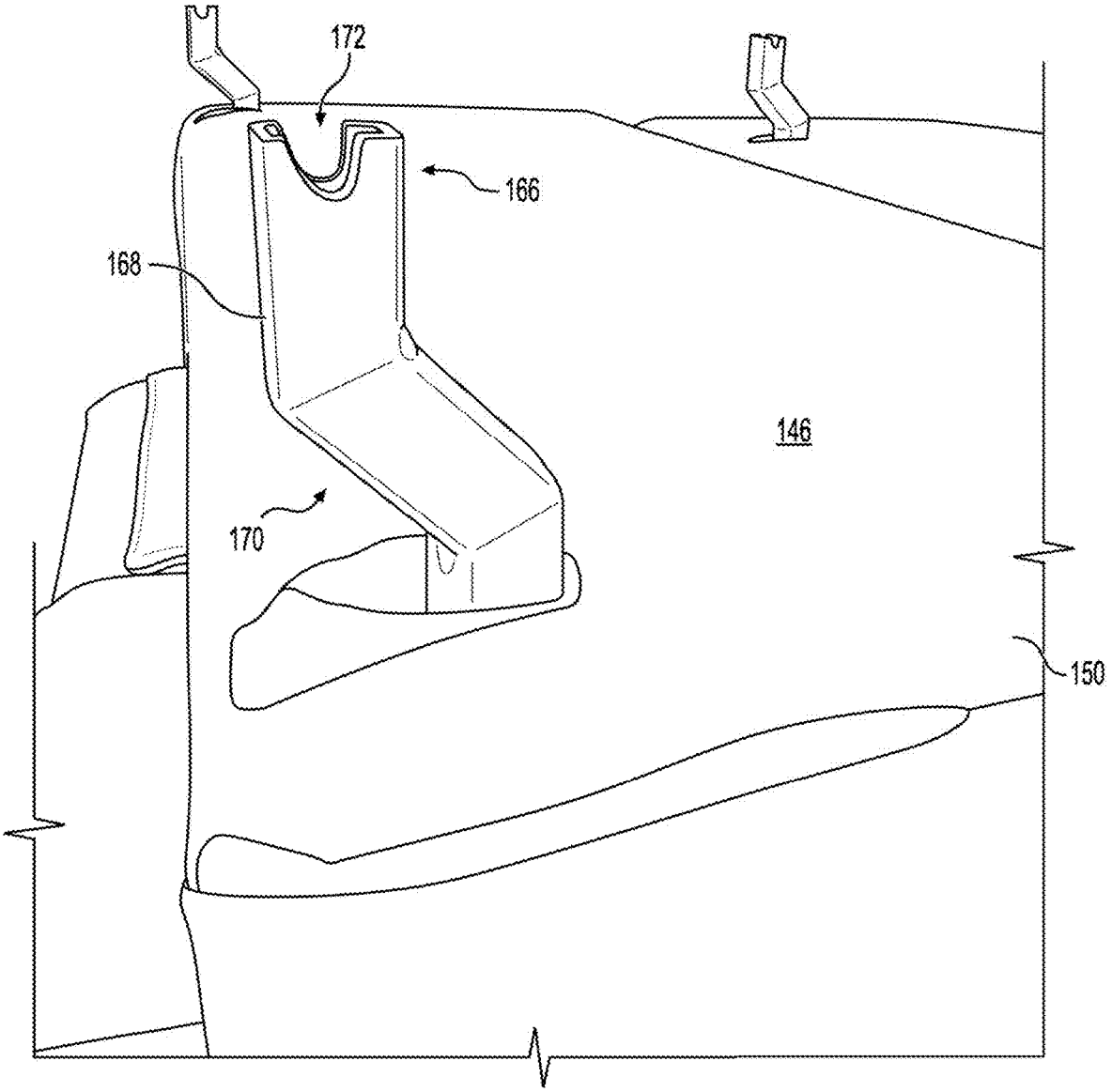
FIG. 10 is a picture showing a view of two (2) armrest cushions laid over their side showing a portion of a mounting rod.

Referring now additionally to FIGS. 7 to 9, comparing the front pole 136 in its first position of FIG. 7 and the front pole 136 is in its second position of FIG. 8, it is worth noting that the unsupported range is shorter on FIG. 7 than on FIG. 8, regardless of the position of the rear pole 138. The shorter is the range between the front pole 136 and the rear pole 138, the firmer the support will be thereby providing an adjustment for the person sitting on the seat cushion 142.

FIG. 9 depicts the unsupported range with cushions 142, 144, 146 installed for reference. For comparison, the seat cushion 142 is depicted laying down over the back adjustable area of the seating structure 105 (depicted in the background on the figure) while a blade 149 is depicted laying down on the poles 136, 138 of the front adjustable area according to the perspective depicted on the figure.

In relation to the assembly comprising the rear pole 138, the inner transversal structures 122 features two abutments, wherein one abutment, the second rear abutment 130, is higher than the first rear abutment 128. Accordingly, a blade 149 supported by the rear pole 138 when the rear pole 138 is in the first configuration (i.e., lower), abutting the first rear abutment 128, has a different slope, namely a greater slope, than when the rear pole 138 is in the second configuration (i.e., higher), abutting the second rear abutment 130.

It should be noted that based on the height of the abutments 124, 126, 128, 130 and the locations of the poles 136, 138 in relation with these abutments 124, 126, 128, 130, adjustments can be made on the support (e.g., firmness and slope) that the seating structure 105 provides to the blades 149 of the seat cushions 142. Therefore, combinations of the depth of the abutments 124, 126, 128, 130 relative to the top face of the inner transversal structures 122 and their locations allow modifying the slope and the firmness of the support provided by the seating structure 105 to the seat cushions 142.

It further should be noted that the base 110 of a sofa 100 may feature a single one or a plurality of adjustable areas wherein each adjustable area comprises at least one pole 136/138 moveable between two (2) positions and at least one (1) seat cushion 142 to contact the pole 136/138 in at least one of the two (2) positions.

It should be noted that the blade 149, which is shown in FIGS. 7 to 9, is, according to a preferred realization, in fact installed within (i.e., under the covering fabric) the seat cushion 142 at the bottom side thereof. Since not the preferred realization, the blade 149 is shown outside the seat cushion 142 for illustrative and explanatory purposes. The blades 149 are adapted to provide support for the cushions 142 while being able to flex. The number of blades 149 per seat cushion 142 depends on the length of the seat cushion 142. In other realizations, alternative blades of the same structure or of an alternative structure and material, may be attached over the seating structure 105 is such a way as to remain in place once the pole(s) 136, 138 is (are) set in place, with the seat cushion 142 afterward being laid down freely over the array of blades.

Therefore, the array of blades providing support can be either part of seat cushion 142 or part of the seating structure 105; the selection of one over the other being a question of design and/or selected configuration.

It is worth noting that, according to realizations, with a seat cushion 142 having a rigid bottom face, the sofa 100 may feature two arms 152/156, rotatable around trunnions 153/157 (see FIG. 6) and displaceable between a first position and a second position, that are adapted to provide an abutting surface on which the seat cushion 142 may be laid. Height of the seat cushion 142 may thus be adjusted by moving both of the arms 152 and/or the arms 156 in the same position to provide balanced left- and right-side supports to the seat cushion 142 and desired height. According to realizations, a pole 138/138 may connect the arms 152/156 at their extremity (see realization depicted e.g., on FIG. 6) or distant from both the abutting surface of the arms 152/156 and the location of the trunnions 153/157 and thus adapted to coordinate the displacement of both arms 152 or 156.

Referring now additionally to FIG. 10 and FIGS. 23, 23A, 24 and 25A-C, the sofa 100 is equipped with backrest cushions 144 and armrest cushions 146 comprising a cushion body (not shown) from which extends a pair of mounting braces 168 that, once mounted to the frame 111, extend toward the interior of the frame 111. The cushion body typically comprises a core (not shown) to which are fixed the mounting braces 168, cushion padding (not shown) substantially wrapping the core, and a cover 150. The cushions 144, 146 are adapted to be mounted to the frame 111, wherein fixation devices, such as screws or bolts, are used to maintain the connection therebetween as is described in relation with FIGS. 17 and 18.

Figure 5:
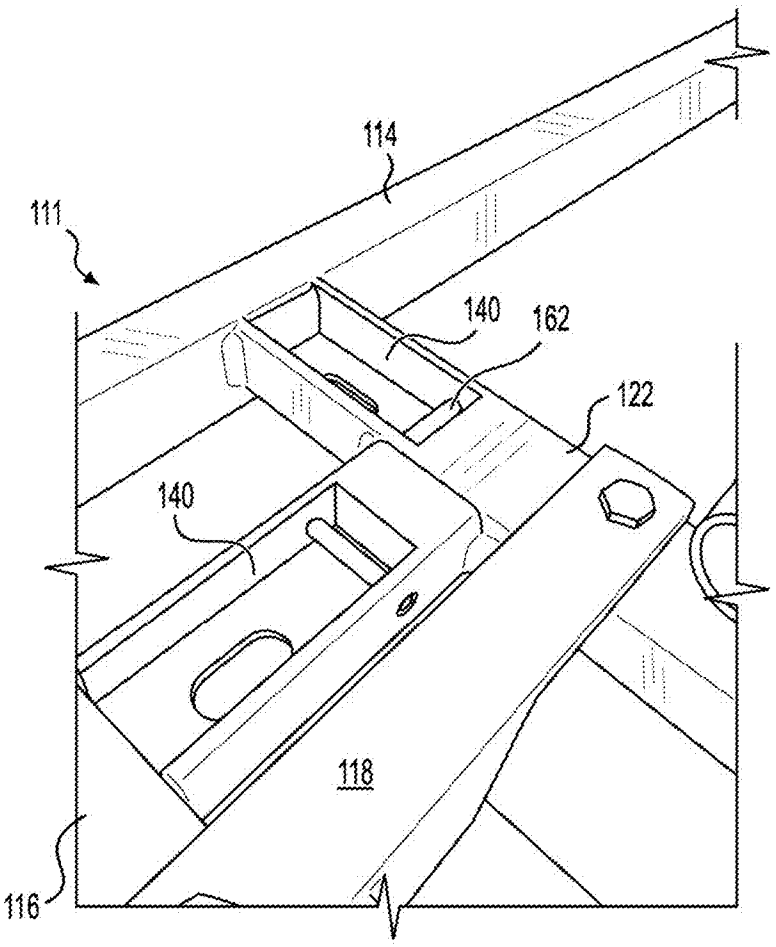
FIG. 5 is a picture showing a close-up view of another portion of the base of FIG. 3.
Figure 4:
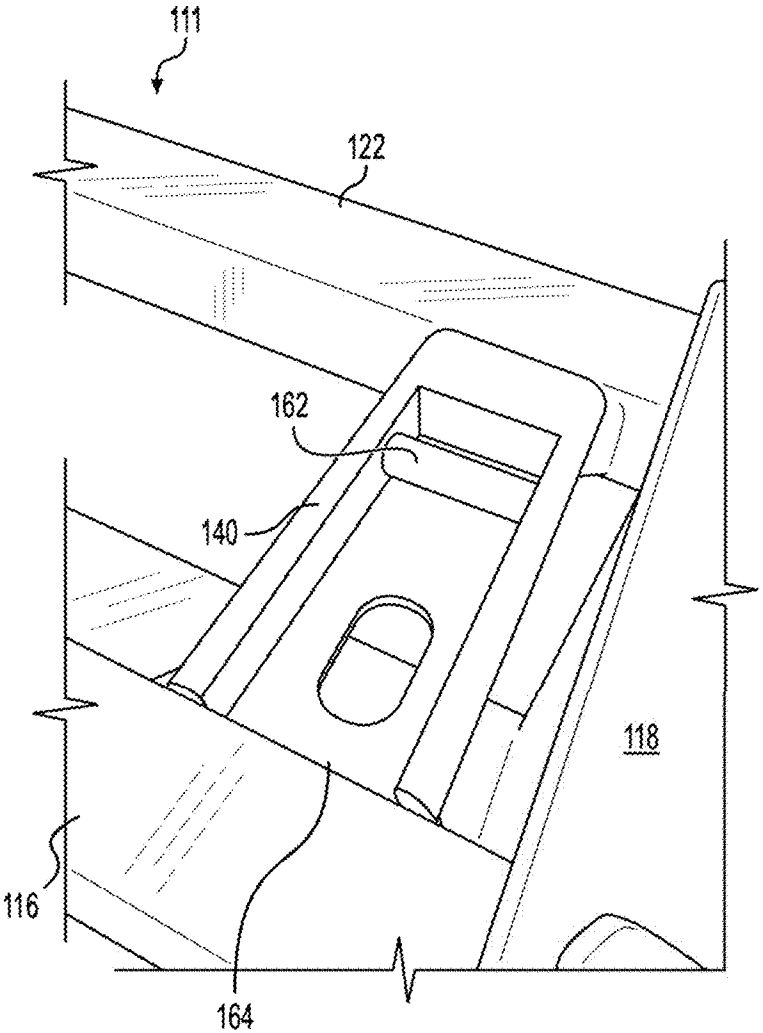
FIG. 4 is a picture showing a close-up view of a portion of the base of FIG. 3.

Referring additionally to FIGS. 4 and 5, the base 110 comprises pairs of mounting brackets 140 with each pair designed to mount one (1) cushion 144/146 thereto. The mounting brackets 140 are typically either mounted at one end to the frame 111 and at the other end to an inner transversal structure 122 or, as part of the inner transversal structure 122 about the rear beam 114. The brackets 140 comprises a housing 182 ending with a horizontal mounting rod 162 designed to cooperate with a brace slit 172 located on the mounting end 166 of the mounting braces 168.

Figure 11:
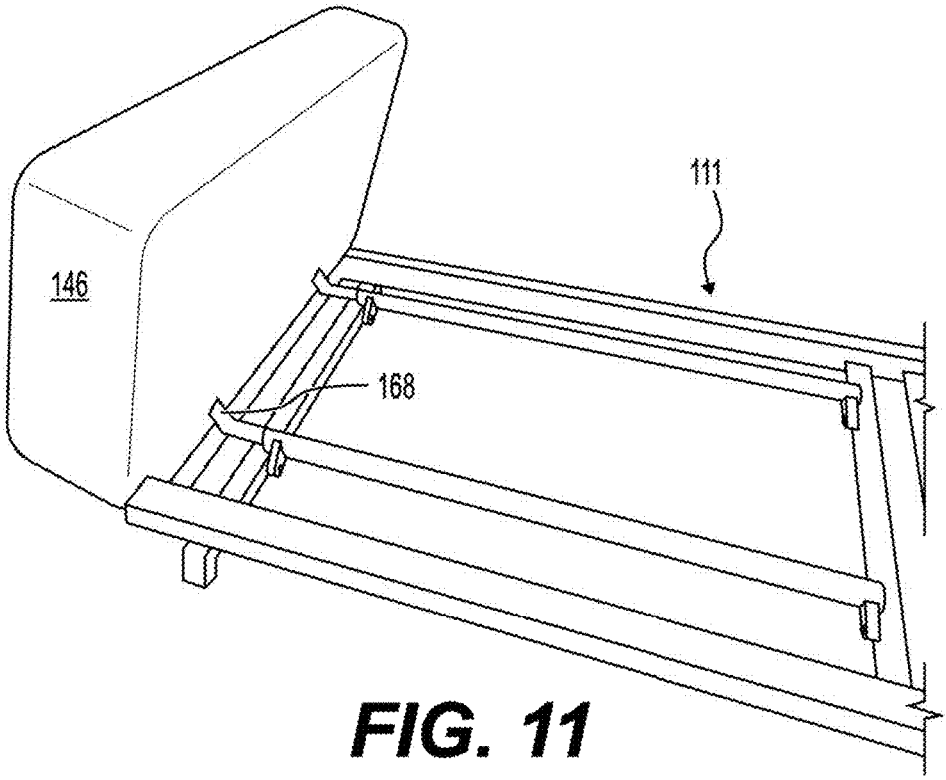
FIG. 11 is a picture showing a perspective view showing the sofa of FIG. 1 at an intermediary state during the installation of an armrest on the base of FIG. 3.
Figure 12:
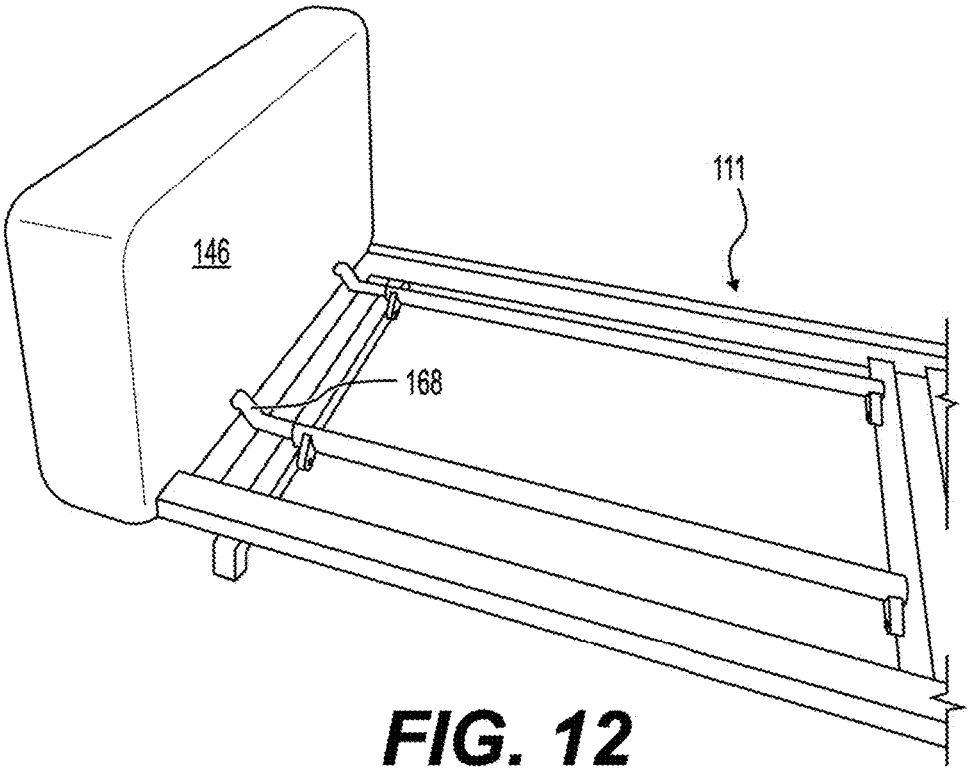
FIG. 12 is a picture showing a perspective view showing the sofa of FIG. 1 at further state after the installation of an armrest on the base of FIG. 3.
Figure 13:
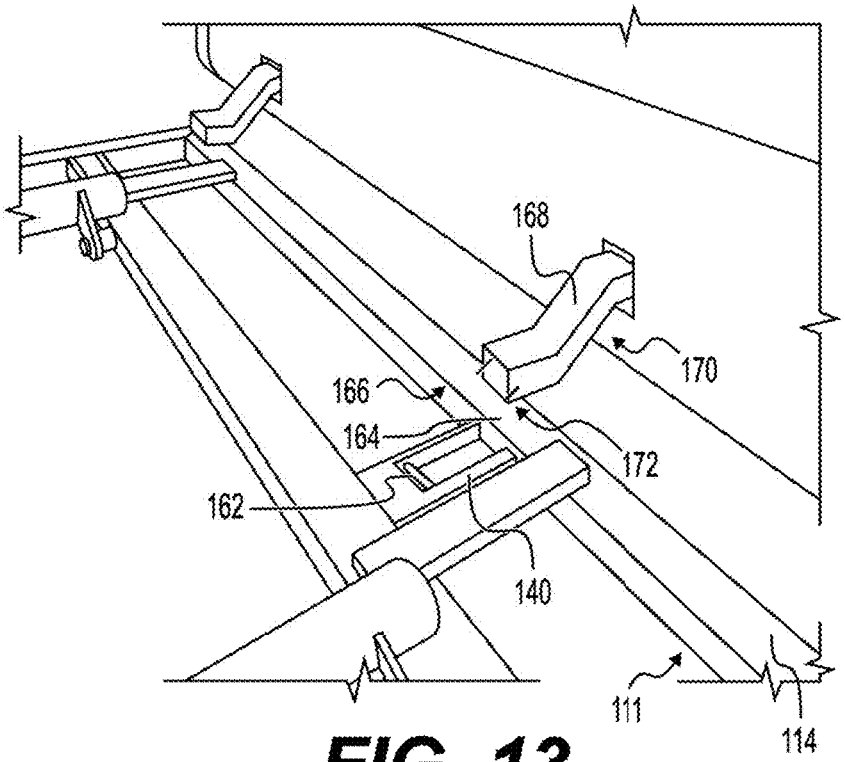
FIG. 13 is a picture showing a closeup perspective view of the sofa of FIG. 1 at an intermediary state during the installation of an armrest cushion on the base of FIG. 3.
Figure 14:
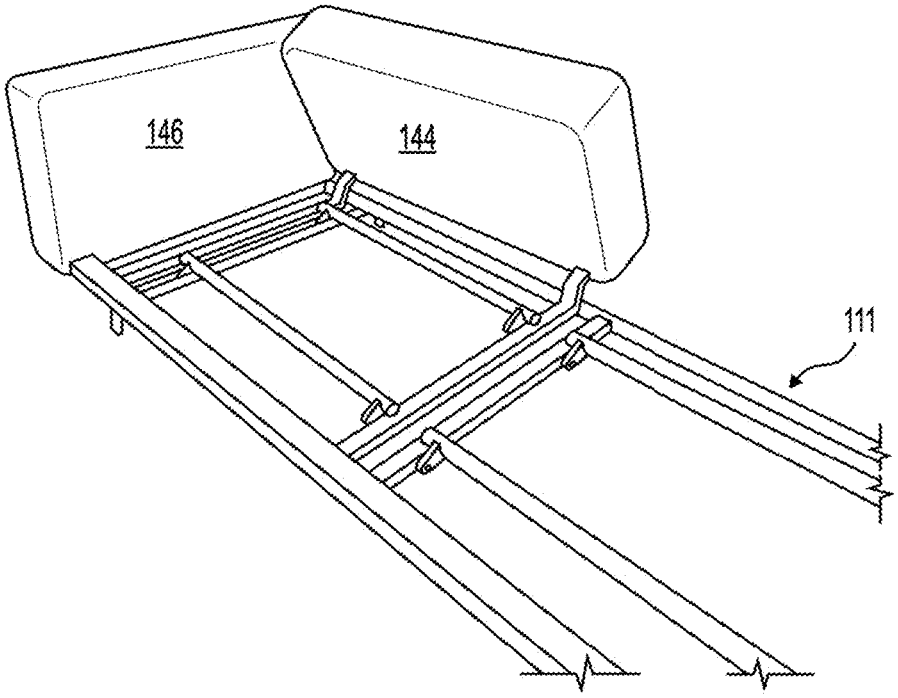
FIG. 14 is a picture showing a perspective view of the sofa of FIG. 1 at a further intermediary state during the installation of a backrest cushion on the base of FIG. 3.
Figure 15:
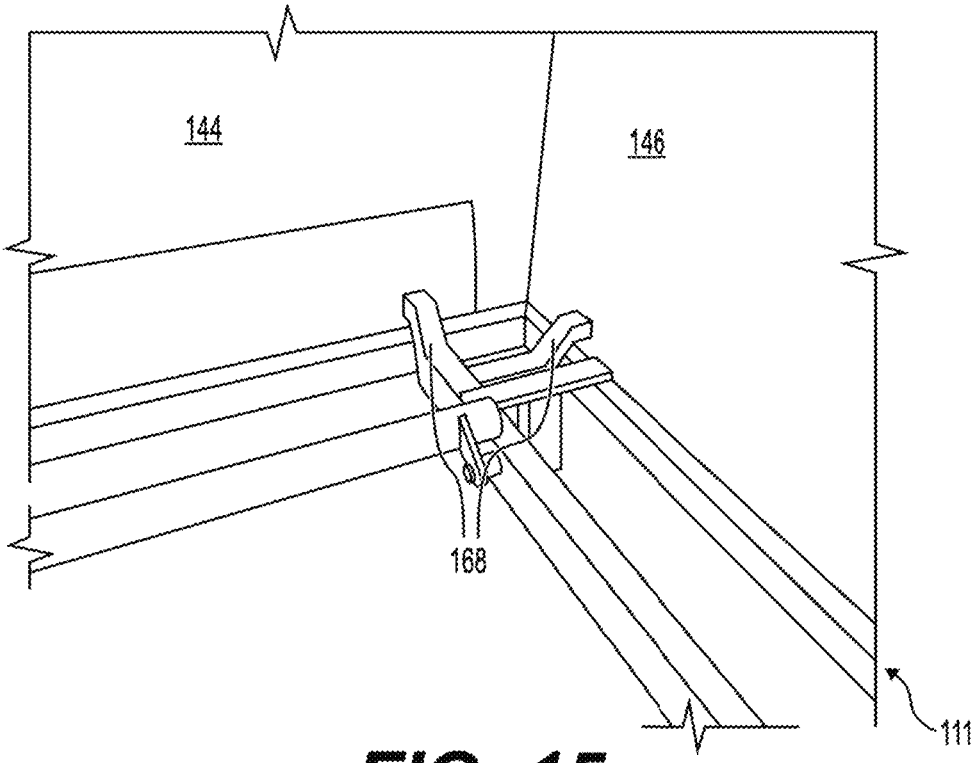
FIG. 15 is a picture showing a closeup view of the base of FIG. 3 with an armrest cushion and a backrest cushion mounted thereon.
Figures 25A, 25B, 25C:
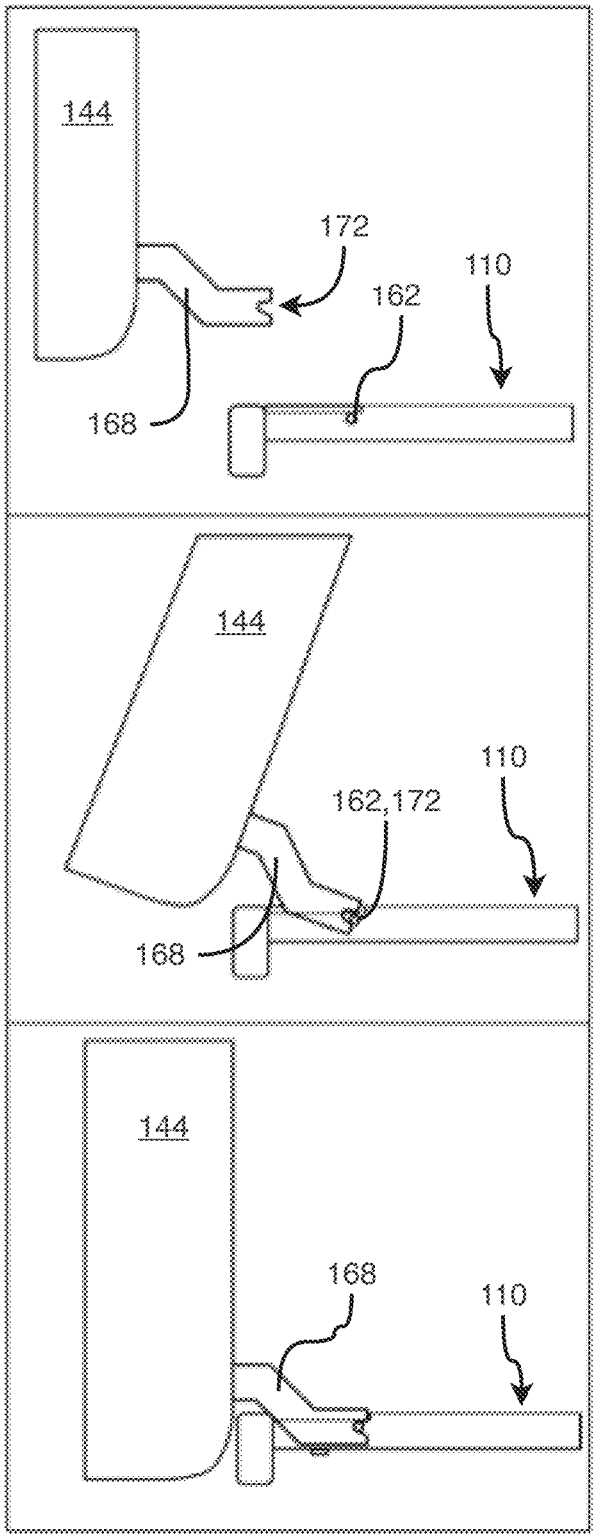
FIGS. 25A to 25C are schematic side views depicting steps of the process of mounting the backrest cushion to the base.

Referring particularly to FIGS. 25A-25, in order to mount a cushion 144/146 to the base 110, the mounting end 166 of the mounting braces 168 are slid in the housing 182 toward the mounting rod 162 until the mounting rod 162 is fully inserted in the brace slit 172 while the mounting end 166 of the mounting braces 168 is being set in the housing 182 of the mounting bracket 140 as depicted on FIG. 25B. Once set in place, as depicted additionally through FIGS. 11 to 13 for an armrest cushion 146 or alternatively additionally through FIGS. 14 and 15 for a backrest cushion 144, the cushion 144/146 is pivoted downward until the cushion 144/146 takes place over the frame 111 as depicted on FIG. 25C. According to realizations, the mounting braces 168 may be designed to abut the frame 111, or alternatively the configuration of the mounting braces 168 may be designed, when the mounting rod 162 is set in place, the down face of the mounting braces 168 is laid over the interior face of the housing 182, and the locking piece 176, e.g., bolt, is firmly screwed, to have a clearance between the frame 111 and the mounting braces 168.

It should be noted that pivoting the cushion 144/146 preferably results in the abutment face 170 of the mounting braces 168 having a sloped configuration abutting a setting abutment 164 that is, according to realizations either part of the mounting bracket 140 or part of one of a front beam 112, a side beam 116 (as depicted on FIG. 13) or a rear beam 114 of the frame 111. That sloped abutment between these pieces pushes the mounting end 166 of the mounting braces 168 toward the interior of the frame 111, securing increasingly the mounting rod 162 in the brace slit 172.

It should further be noted that the housing 182 of the mounting bracket 140 receiving the mounting end 166 of the mounting braces 168 has a C shape that prevents frontward/rearward displacements of the armrest cushions 146 and sideward displacements of the backrest cushions 144. It results is a well-secured mounting of the cushions 144/146 requiring both to lift and pivot the cushion 144/146 toward the interior of the frame 111 to dismount it.

Figure 16:
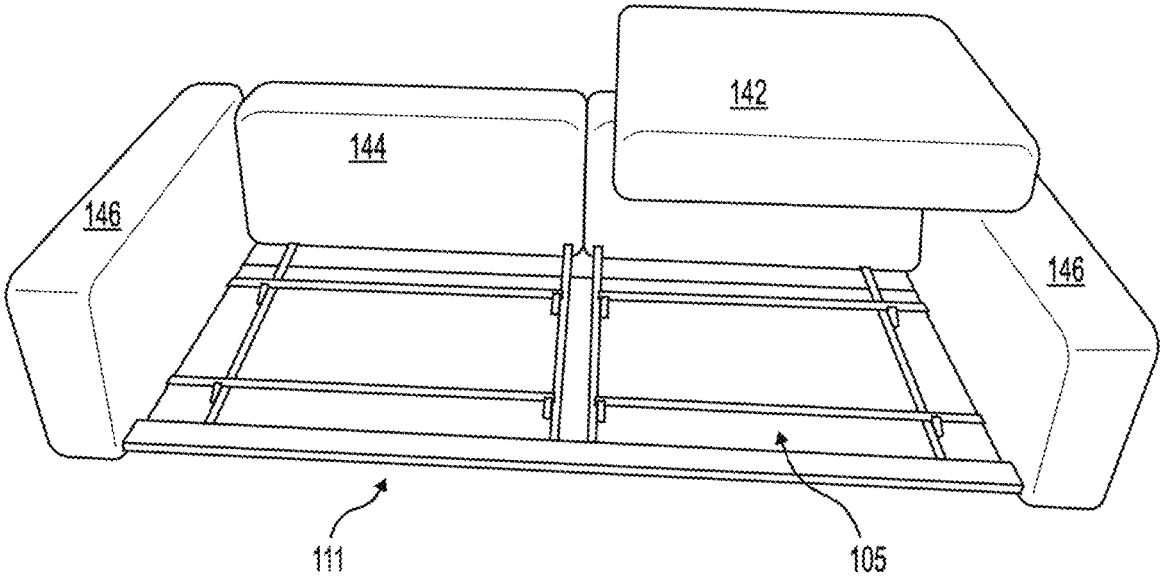
FIG. 16 is a picture showing a perspective view of the base of FIG. 3 with all the armrest cushions and backrest cushions mounted thereto.
Figure 17:
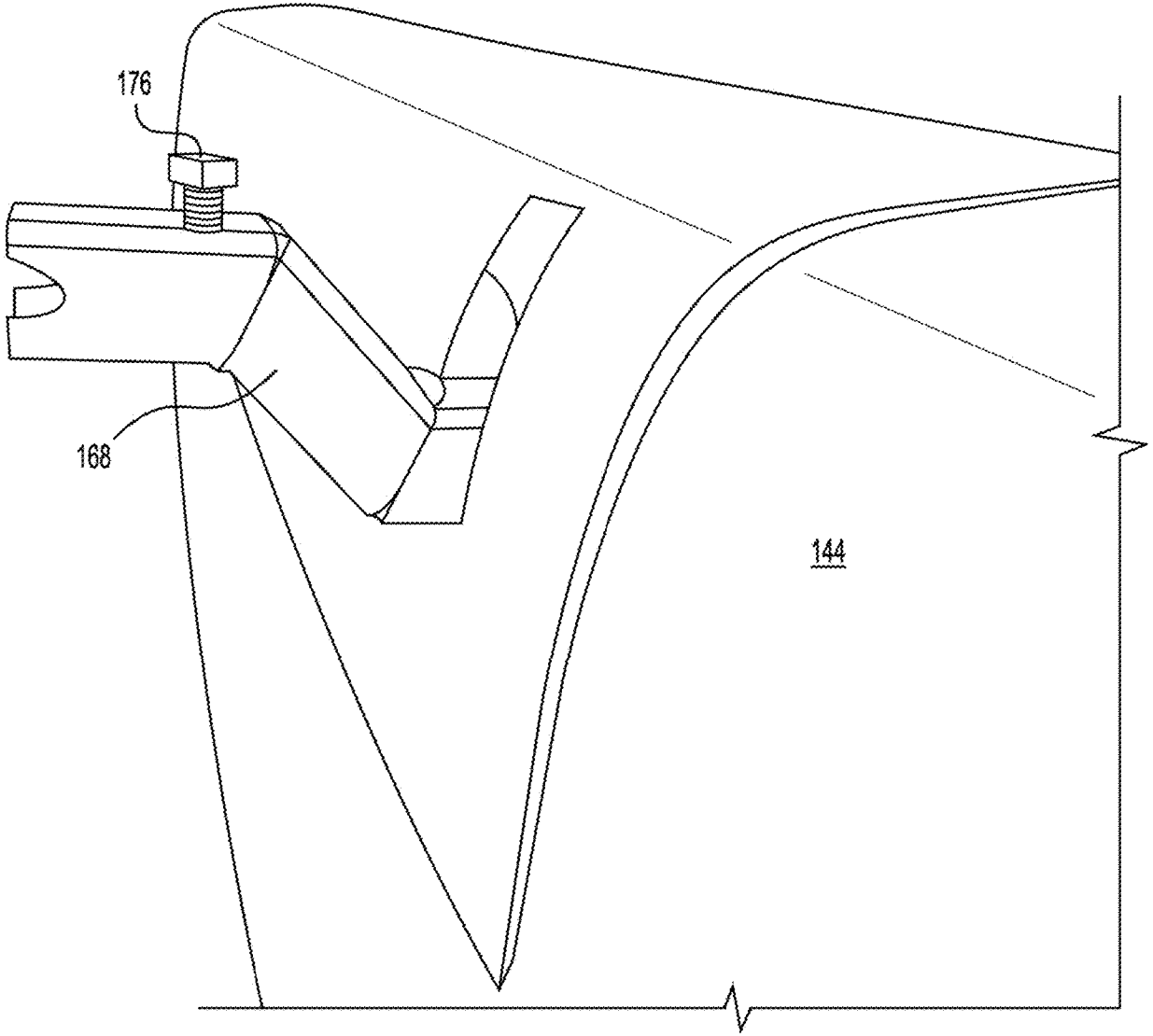
FIG. 17 is a picture showing a closeup perspective view of a backrest cushion.
Figure 18:
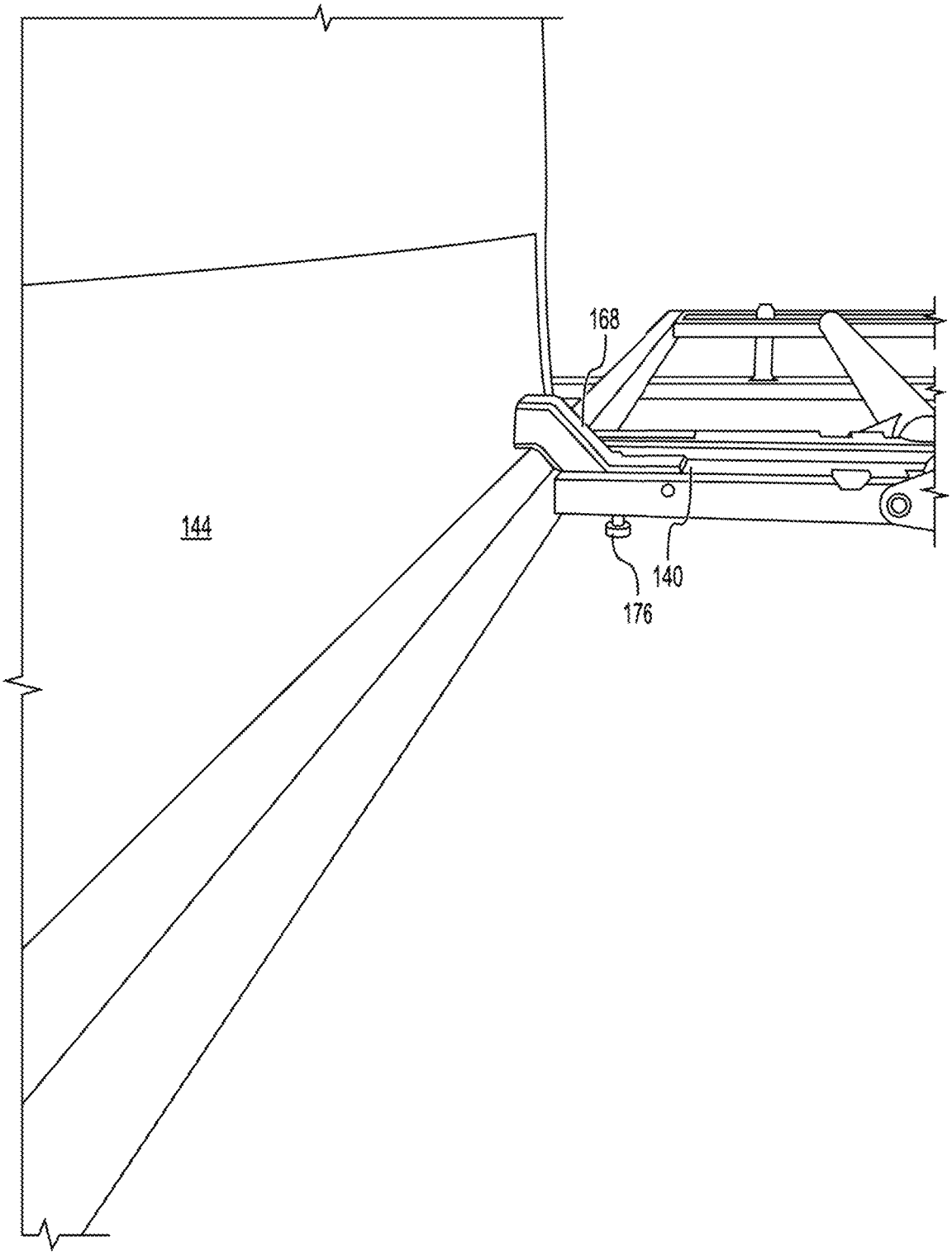
FIG. 18 is a picture showing a closeup perspective view of the sofa.
Figure 19:
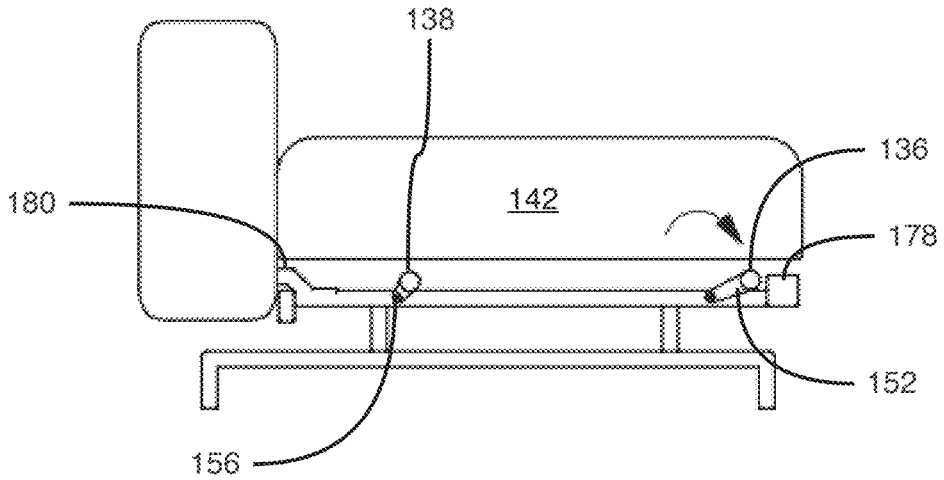
FIGS. 19 to 22 are schematics depicting a side view of the sofa of FIG. 1 with the poles being moved in different positions with the sofa adopting therethrough different slopes and levels of firmness.
Figure 20:
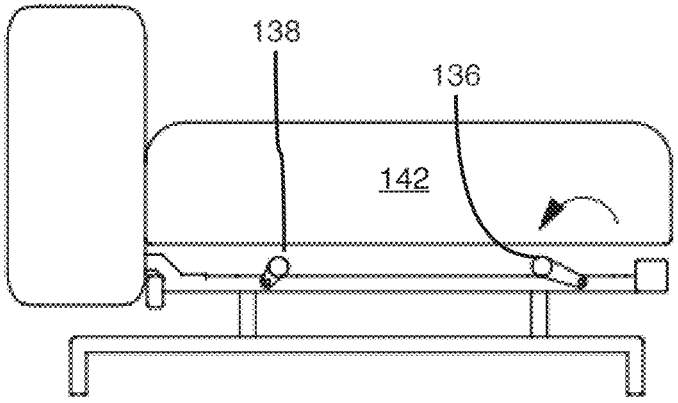

Referring to FIGS. 16 to 18, once the armrest cushions 146 and the backrest cushions 144 mounted to the frame 111, seat cushions 142 are laid over the seating structure 105, providing extra help in maintaining the armrest cushions 146 and the backrest cushions 144 in place, thus in providing resistance to their pivoting for dismounting from the frame 111. To ensure the mounting remains once the backrest cushions 144 in place, a locking piece 176, aka a secure lock, is mounted from under the mounting bracket 140 that maintains the relative position of the mounting brace 168 in the mounting bracket 140.

According to the described realization, the locking piece 176 is screwed in the mounting brace 168. Nevertheless, other means of securing are contemplated through the present description.

It finally should be noted that the brace slit 172 and the mounting rod 162 are complementary mounting structures that may be inverted in an alternative realization. The complementary mounting structures are designed to be joined to each other in a first position, aka an initial pivoted position, and to remain joined to each other when pivoting the cushion in its final non-pivoted position where the abutment of the mounting braces abuts one of the frame 111 and the mounting bracket 168, and wherein the cushion 144/146 is mounted to the frame 111 and stands above the frame 111.

Referring to FIGS. 26 to 28A and 29 to 31A, the present sofa may be configured in a low position or a in a high position. Z-shaped mounting wings 188 are mounted on the sides of frame 111 and are adapted to be mounted to leg structures 118 through poles 190. To mount the frame 111 to the leg structures 118 at the selected height, either the low face 192 or the high face 194 of each of the mounting wings 188 are laid down on the poles 190 of the leg structures 118 and secured thereto with a screw 196. Therefore, by selecting to which of the low face 192 and the high face 194 the pole 190 may be engaged to, the height of the frame 111, and thus of the sofa is adjusted.

Referring to FIGS. 32A to 34C, the modular sofa may take any of a plurality of configurations.

Figure 32A:
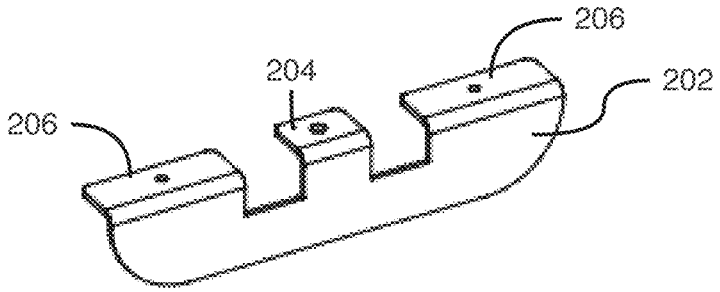
FIG. 32A to 32C are respectively, a perspective view of a bracket used for joining two (2) modules of the sofa of FIG. 1 side-by-side when a single leg structure is used at the junction of the modules, a perspective view of two modules about to be mounted side-by-side, and a perspective view of a closeup section of the joining structure of the two (2) modules.
Figure 32B:
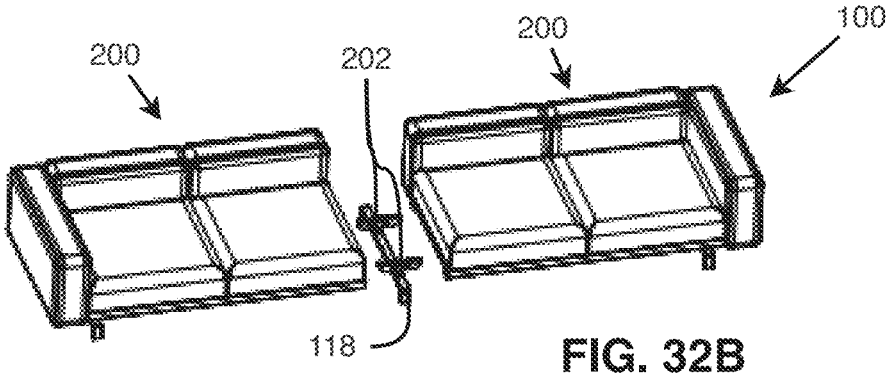
Figure 32C:
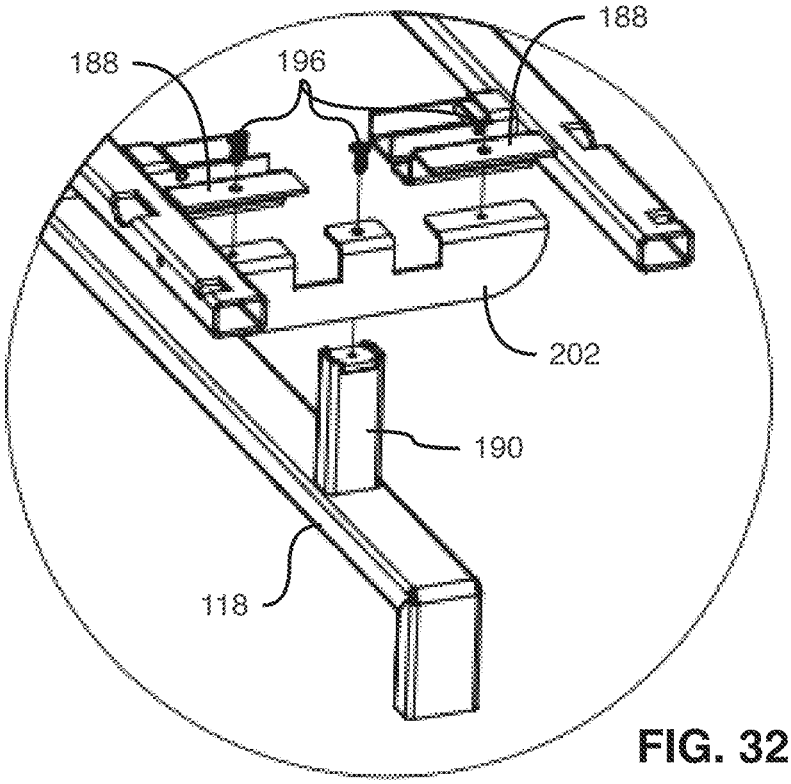

Referring to FIGS. 32A-32C, the modular sofa may be mounted with two (2) modules 200 mounted side-by-side with a single leg structure 118 used at the junction of the modules 200. To join the modules 200, a pair of brackets 202 each having a central junction face 204 and two (2) side junction faces 206 are used. The central face 204 of the bracket 202 is mounted to the end of each of the poles 190, and the face 192/194 of the mounting wings 188 is mounted to the side junction faces 206. The junction is secured with screws 196 securing the modules 200 to each other and to the leg structure 118 through the bracket 202 while still providing solution for height adjustment of the frames 111 of the modules 200.

Figure 33A:
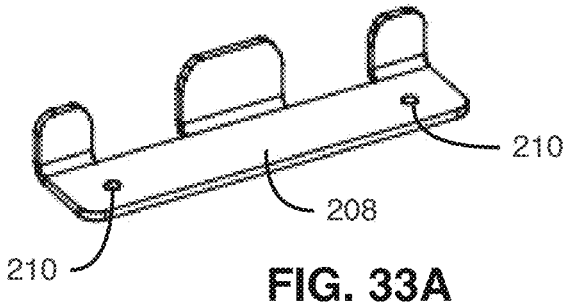
FIG. 33A to 33C are respectively, a perspective view of a bracket used for joining two (2) modules of the sofa of FIG. 1 side-by-side when each module has its own leg structure, a perspective view of two modules about to be mounted side-by-side, and a perspective view of a closeup section of the joining structure of the two (2) modules.
Figure 33B:
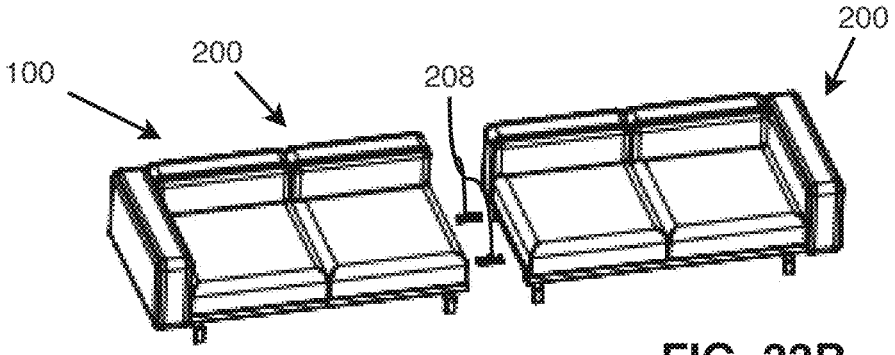
Figure 33C:
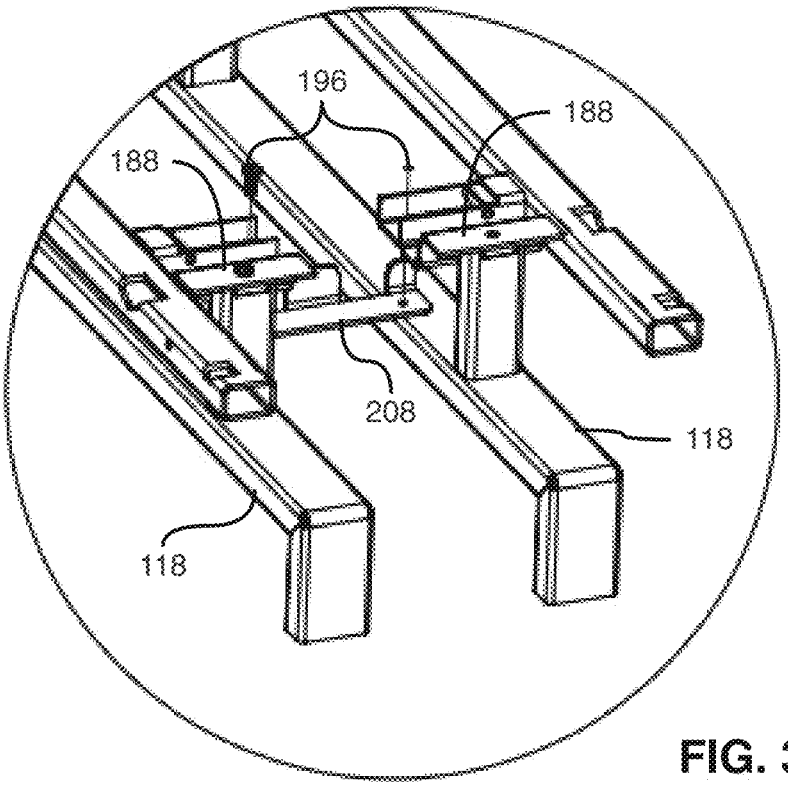

Referring to FIGS. 33A-33C, two (2) side-by-side modules 200 can be joined to each other when each are mounted to its own leg structure 118. A bracket 208 comprises two extremities with holes 210 about each of the extremities to be secured to the mounting wings 188. The modules 200 are mounted side-by-side by placing them at the appropriate location relative to each other and having the bracket 208 secured with a screw to the face 192/194 unused to mount the frame 111 to the leg structure 118. Two brackets 208 are used to join the modules 200, one about the front pole 190 and one about the rear pole 190 of the leg structures 118.

Figure 34A:
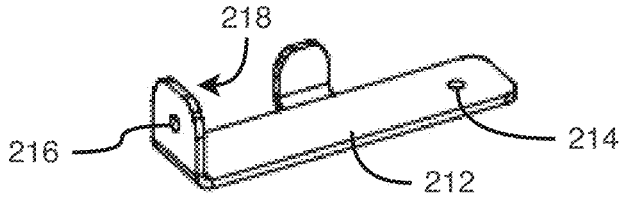
FIG. 34A to 34C are respectively, a perspective view of a bracket used for joining two (2) modules of the sofa of FIG. 1 in a L-shape configuration, a perspective view of two modules about to be mounted in the L-shape configuration, and a perspective view of a closeup section of the joining structure of the two (2) modules.
Figure 34B:
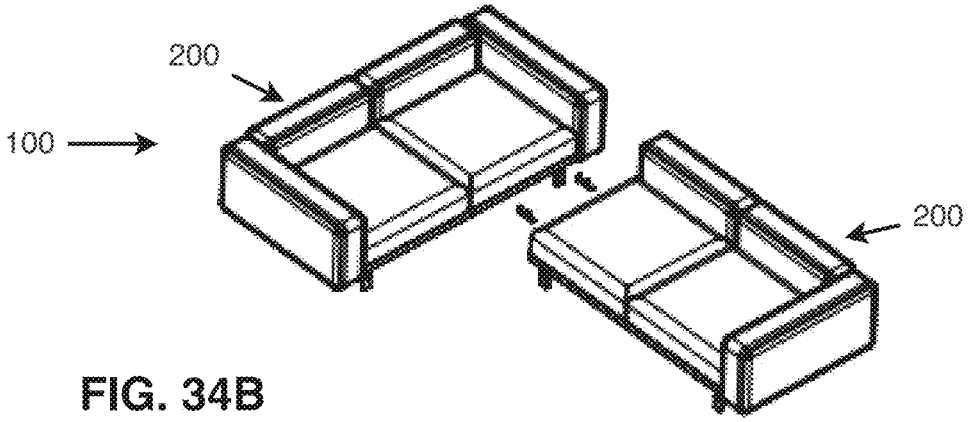
Figure 34C:
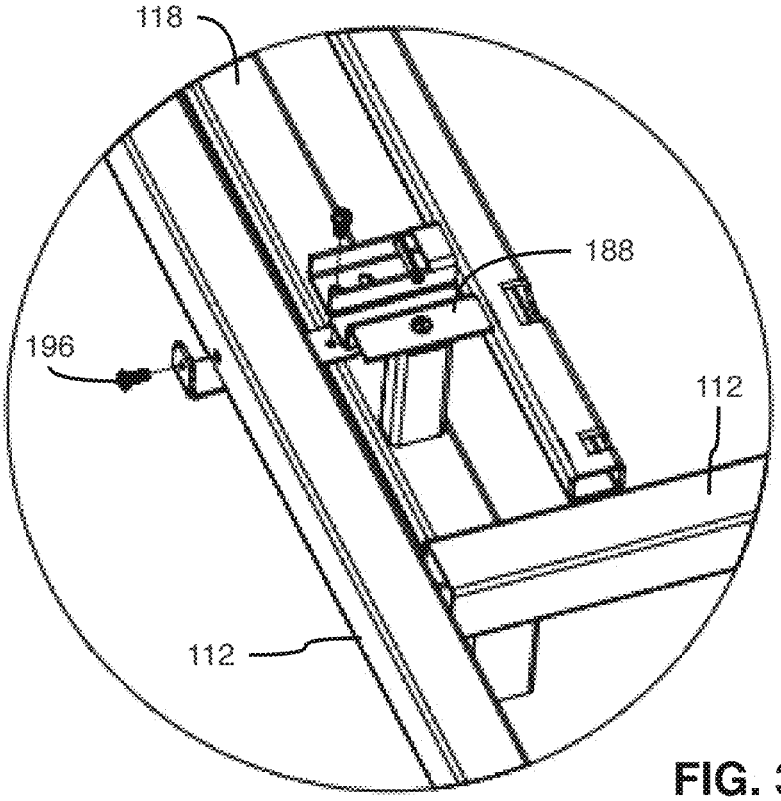

Referring to FIGS. 34A-34C, the modules 200 can be mount in a L-shaped configuration, wherein the side of a first module 200 abuts the front of the other module 200. A bracket 212 having a first junction hole 214 and second junction hole 216 is adapted to join the modules 200. The first junction hole 214 is on a main extending surface about a first extremity, and about the other extremity the bracket 212 is bent to offer a clamping face 218 on which the second junction hole 216 is located. Joining the modules 200 involves securing the bracket 212 to the first module 200 through the first junction hole 214 secured to the mounting wing 188, and securing the clamping face 218 of the bracket 212 to the other module 200 through the second junction hole 216 being secured to the front beam 112 with screws 196. Two brackets 212 are used to join the modules 200 in the L-shaped configuration, one about the front pole 190 and one about the rear pole 190 of the leg structure 118 of the first module 200 which abuts the front of the other module 200 of the sofa 100 in the L-shaped configuration.

Figure 35A:
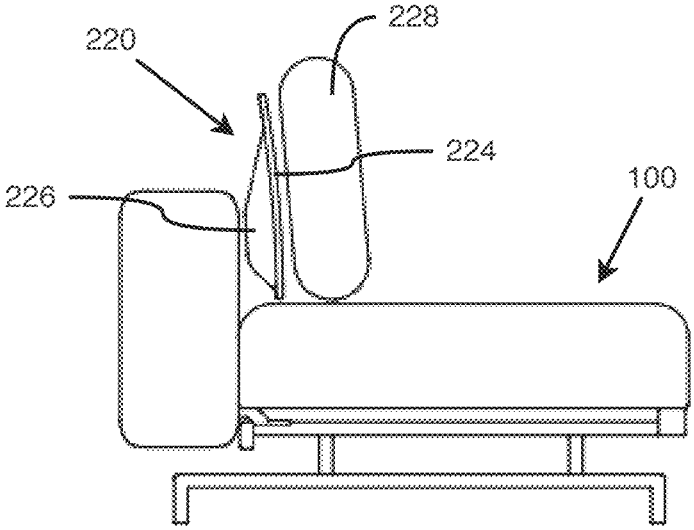
FIGS. 35A-C are side views of the sofa of FIG. 1 with a lumbar support component providing support to a back-support cushion, wherein the lumbar support component is depicted respectively in a first position, a second position and a third position.
Figure 35B:
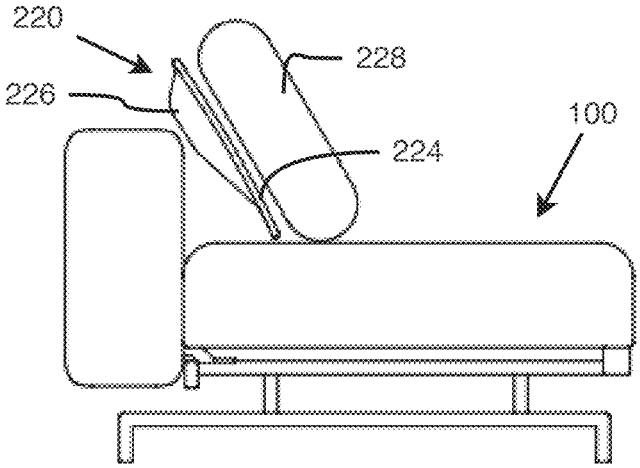
Figure 35C:
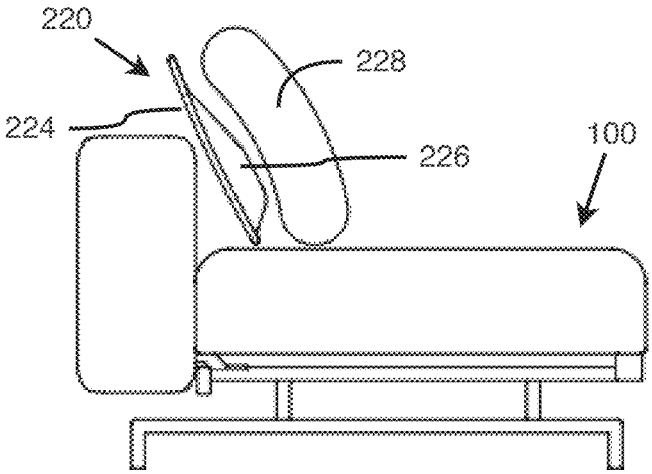

Referring to FIGS. 35A-C, a lumbar support component 220 comprises a substantially flat rigid face 224 and opposed thereto an eccentrically bulging face 226, e.g., a cushioned face located relatively close to e.g., a first edge. The lumbar support component 220 is designed to be installed behind a cushion 228 providing support to the spine of someone sitting on the sofa 100. As depicted on FIGS. 35A-B, the lumbar support component 220 may be installed with the substantially flat rigid face 224 facing the cushion 228, wherein, according to the angle the lumbar support component 220 is installed, the cushion 228 provides a more or less sloped flat support. As depicted on FIG. 35C, the lumbar support component 220 may be installed with the bulging face 226 providing support to the cushion 228, thereby providing a not-flat support to the cushion 228, and more precisely a convex support thereby providing extra support about the lumbar section of the spine of the user when the bulging portion is in the lower section. With the adjustable lumbar support component 220 easy to place in any direction and angle to fit the desired and needs, it is fast and easy for someone to adjust the lumbar support component 220 to the desired comfort.

Figure 36:
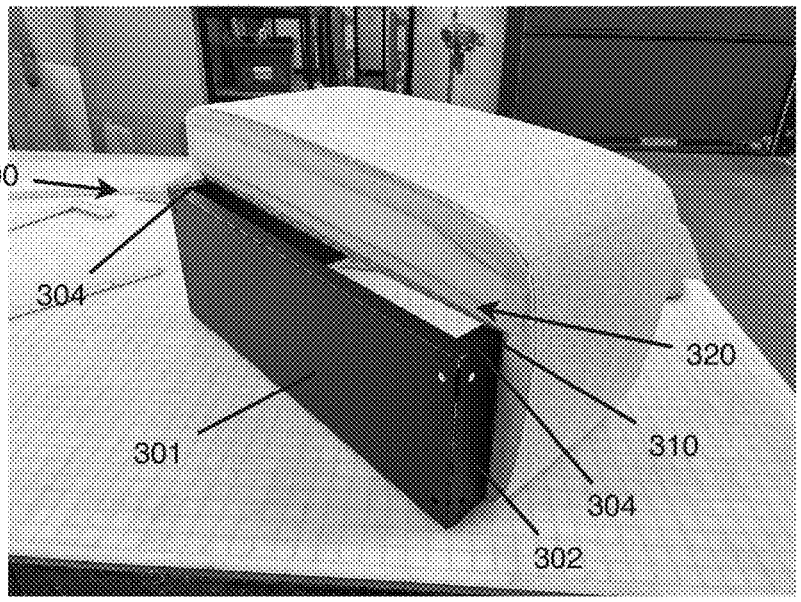
FIG. 36 is a perspective elevation view of a piece of furniture with a portion of the blade assembly removed in accordance with an embodiment.
Figure 37:
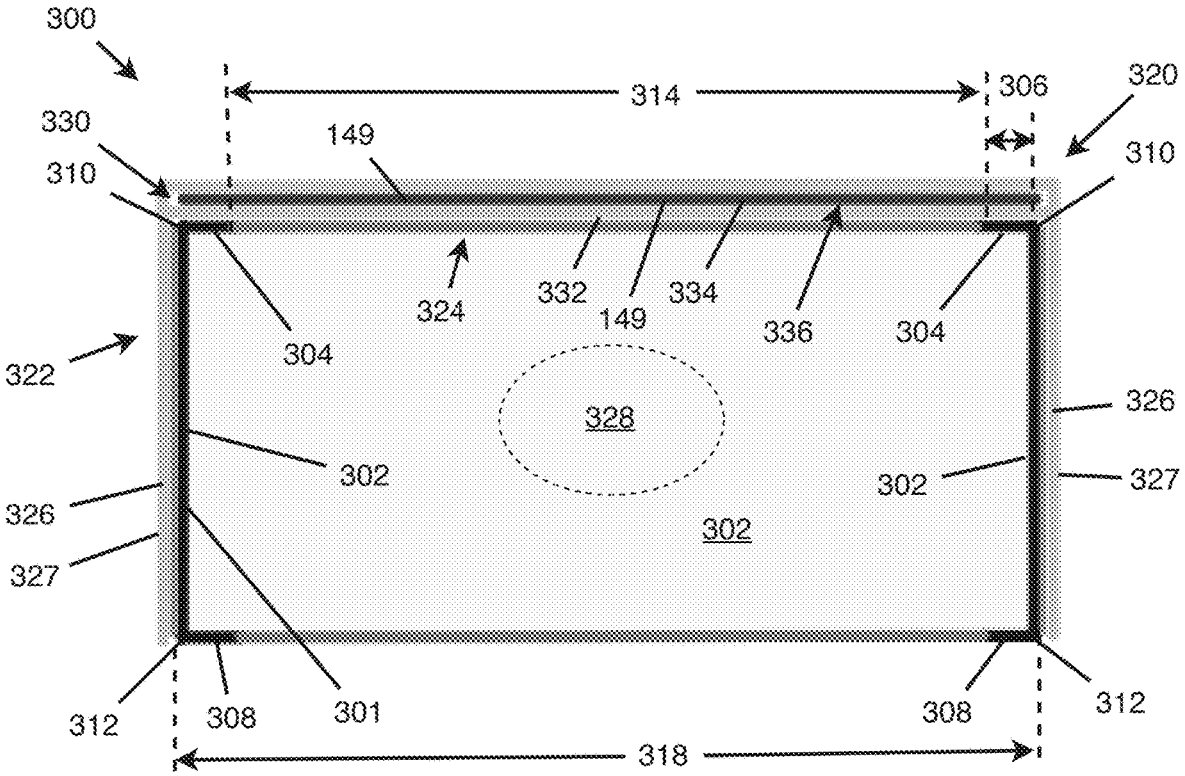
FIG. 37 is a cross-section elevation view of a piece of furniture according to a transversal point of view, with a portion of a side wall removed, in accordance with an embodiment.

Referring now to FIGS. 36 to 37, a method of using blades 149 into pieces of furniture 300 and embodiment of pieces of furniture through use of the blades 149 are described.

Referring particularly to FIGS. 36 and 37, the piece of furniture 300 comprises a structure 301 having side walls 302 and top walls 304 adjoining the side walls 302 through adjoining edges 310, and extending away from the adjoining edges 310 over a transversal length 306 such that the top walls 304 provide a top surface for abutments of a blade assembly 320. The structure 301 further features a support-free area 314 between the top walls 304.

According to the embodiment, the structure 301 is made of painted steel, or another material painted or treated otherwise against corrosion.

According to the exemplary embodiment, the structure 301 comprises four (4) side walls 302. In other embodiments, the structure may have more or less side walls without departing from the scope of the present disclosure.

According to the exemplary embodiment, the side walls 302 extend without opening therein or fittings secured thereto. In other embodiments, the side walls may feature openings, or extend over less length away from the adjoining top wall, for e.g., lighter structure, or have fittings secured thereto for assembly with other components, without departing from the scope of the present disclosure.

According to the exemplary embodiment, the side walls 302 are adjoining to each other to form an enclosure. In other embodiments, side walls may be discrete relative to each, secured to each other over only a portion of adjoining edges, or adjoined through an intermediary component without departing from the scope of the present disclosure.

According to the exemplary embodiment, the top walls 304 adjoin each of the side walls 302, In other embodiments, number of top walls may be limited to two (2), may extend over less the whole edge of the side wall adjoining the top wall, or extend over a greater length than the edge of the side wall adjoining the top wall without departing from the scope of the present disclosure. Minimum number and length of the top walls are depending only on the function they perform as will become apparent from the explanation hereinafter.

According to the exemplary embodiment, bottom walls 308 are adjoining the side walls 302 at a bottom edge 312 distant from the top walls 304. The bottom walls 308 are for supporting the piece of furniture 300 with lower probability of marking the surface on which the piece of furniture 300 is placed. In other embodiments, bottom walls may be absent, or may be replaced with legs, or may be designed to perform another function without departing from the scope of the present disclosure.

According to the exemplary embodiment, an adjoining top wall 304 and side wall 302 are made from a single sheet of metal folded to provide the walls in the desired configuration.

Back to FIGS. 36 and 37, the blade assembly 320 comprises an envelope 322 made of resistant fabric, preferably made of MIP (Mattress Insulated Pad) from Jazstex. The envelope 322 comprises a support portion 324 and side panels 326. The support portion 324 of the envelope 322 has a transversal dimension 318 that is adapted to extend from one adjoining edge 310 from which extends a top wall 304 to another adjoining edges 310 from which extends another top wall 304. Preferably, the bottom layer 332 of the support portion 324 is determined such that the support portion 324 does substantially cover the distance between the adjoining edges 310, and preferably do not extend with a cantilever portion extending beyond the structure 301.

Beyond the support portion 324, side panels 326 extends on both directions to follow the side walls 302.

In a preferred embodiment, the blade assembly 320 comprises one (1) support portion 324 and four (4) side panels 326, more specifically two (2) end side panels 327 and two (2) edge side panels 328, with the side panels 327, 328 extending from the support portion 324 over about the length of the side walls 302. Accordingly, when the blade assembly 320 is laid over the structure 301, the support portion 324 rests on top of the structure 301 while the side panels 327, 328 follow the side walls 302 down to about the bottom edges 312. Accordingly, the blade assembly 320 is thereby designed to snuggle the structure 301.

The support portion 324 features a bottom layer 332 and a top layer 334 joined with each other to define parallel longitudinal sleeves 336 adapted to receive the blades 149 that extend from the junction to one bottom layer 332 to the junction to another bottom layer 332.

In a preferred embodiment, the bottom layer 332 and the top layer 334 are sewed with each other, isolating the longitudinal sleeves 336 from each other, with at least one end 330 of the longitudinal sleeve 336 remaining open. The top layer 334 is joined, preferably sewed, to the end side panels 327 so that the longitudinal sleeve 336 is accessible when the blade assembly 320 is upside down and the end side panels 327 hanging, but the end side panel(s) 327 blocking the opening of the longitudinal sleeves 336 when turned upside up and the end side panels 327 hanging.

In the exemplary embodiment, the top layer 334 and side panels 326 are sewed to each other. In other embodiments, the top layer 334 and at least side panel 326 are from the same piece of continuous fabric without departing from the scope of the present disclosure.

it is worth mentioning that other means for securing the pieces of fabric such as gluing, heat fusing, stappling, etc. are contemplated through the present description.

It is worth mentioning that in the exemplary embodiment, the top layer 334 and the bottom layer 332 are made with the same fabric. In alternative embodiments, the top layer 334 and the bottom layer 332 are made with different fabrics without departing from the scope of the present disclosure.

The blade assembly 320 further comprises the blades 149 inserted in the at least one open end 330 of the longitudinal sleeves 336. The blades 149 have a length that is greater that the dimension of the support-free area 314. They are designed to extend over the support-free area 314 abutting at least a portion of the top walls 304, and preferably designed to extend over the whole length of the longitudinal sleeves 336.

It is encompassed therethrough that the dimensions of the piece of fabric used for the bottom layer 332 and the top layer 334, before joining, may differ from the dimension of the resulting support portion 324. These differences of dimension may, for instance, be to provide increased volume for the longitudinal sleeves 336 to be able to house the blades 149. For example, in one embodiment, the bottom layer 332 is wider than the top layer 334 for the longitudinal sleeves 336 to be domed downward once the blades 149 inserted therein.

According to a preferred embodiment, the top walls 304 have a length 306 of 20 mm, and preferably at least 25.4 mm transversal to the adjoining edges 310, thereby providing the required support.

According to a preferred embodiment, a piece of furniture 300 made with blades 149, preferably stats Goodside™ from OKE, having a width of preferably 36 mm, the support-free area 314 has a length of 500 mm, preferably at least 600 mm, and of at most about 1100 mm, preferably at most about 1000 mm, transversal to the adjoining edges 310.

According to a preferred embodiment, the blades 149 are made of a combination of plastic and fiberglass co-extruded in a single component having the desired characteristics in e.g., flexibility, resistance, and compactness.

It is worth mentioning that, with the present technique, blades are not glued nor having, e.g., their ends rigidly set into, e.g., a metal frame. The present technique is therefore particularly useful when considering blades made of material difficult to glue, materials for receiving blades that are difficult to glue on, or blades made of material that would result in premature wear of the blades if the blades where inset, shortening the life of the blades and in consequence of the whole piece of furniture. It is further worth mentioning that blades having a non-flat surface, e.g., featuring a longitudinal fin, would be more difficult to glue. Such non-flat blades, with the present technique, would not result in premature wear or discomfort, since the top layer 334 isolates the blades from people or other portion of a finalized piece of furniture, e.g., a cushion.

In is also worth mentioning that with top walls designed to supporting ends of blades, when the top walls, and particularly the adjoining edges, are not parallel to each other, the ends of the blades are cut with the same shape of the adjoining edges, having the combined ends of the blades on both side defining combined edges following the adjoining edges of the structure.

Back to the Figs., the support portion 324 is designed to cover the top surface of the structure 301, comprising the support-free area 314 and the adjoining top walls 304, with portions of the blades 149, about each end of the blades 149, adapted to lay on a top wall 304 of the structure 301. Thereby, the blades 149 are maintained in place through the physical hindrances provided by the longitudinal sleeves 336 and by the side panels 326, while allowing flexion of combination of the longitudinal sleeves 336 and the blades 149 inserted therein over the support-free area 314.

In a preferred embodiment, the blade assembly 320 is glued to the structure 301, According to an embodiment, at least the end side panels 327, and more preferably all side panels 326, are glued to side walls 302 of the structure 301. According to another embodiment, a portion of the support portion 324 is also glued to the top walls 304.

Figure 38:
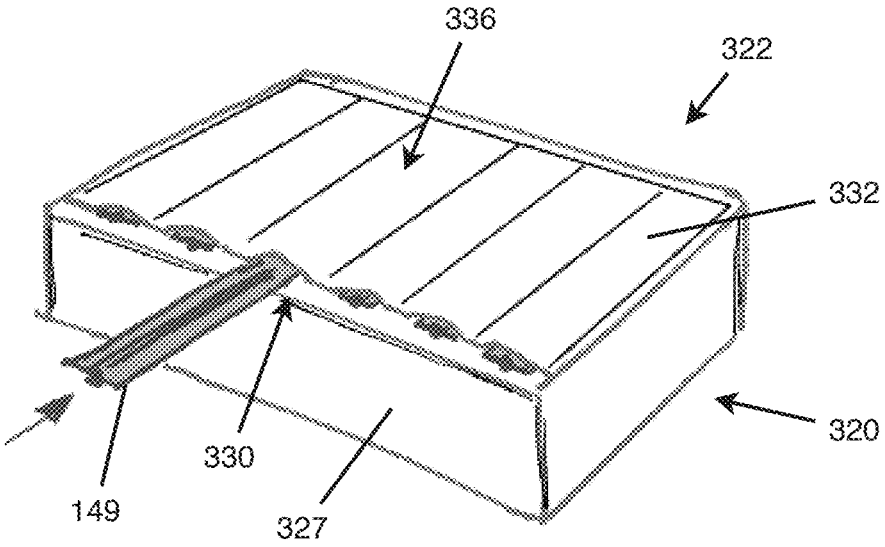
FIG. 38 is a perspective view of a blade assembly turned upside down during the inserting of a blade in a longitudinal sleeve in accordance with an embodiment.
Figure 39:
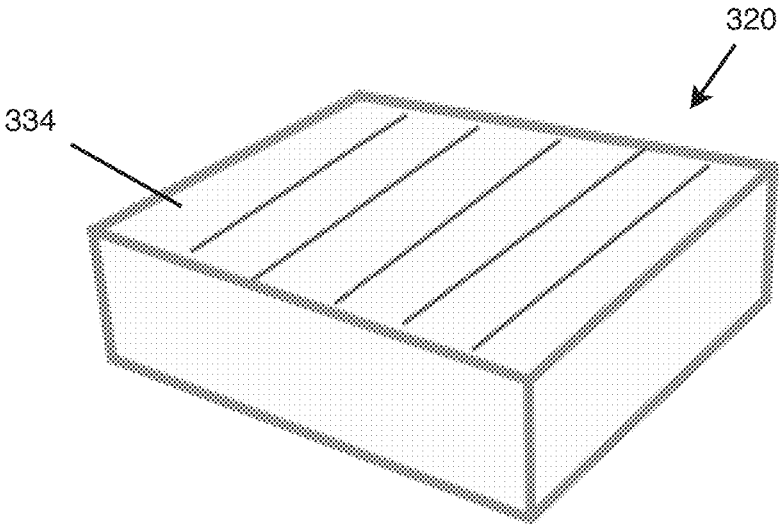
FIG. 39 is a perspective view of the blade assembly of FIG. 38 turned upside up.
Figure 40:
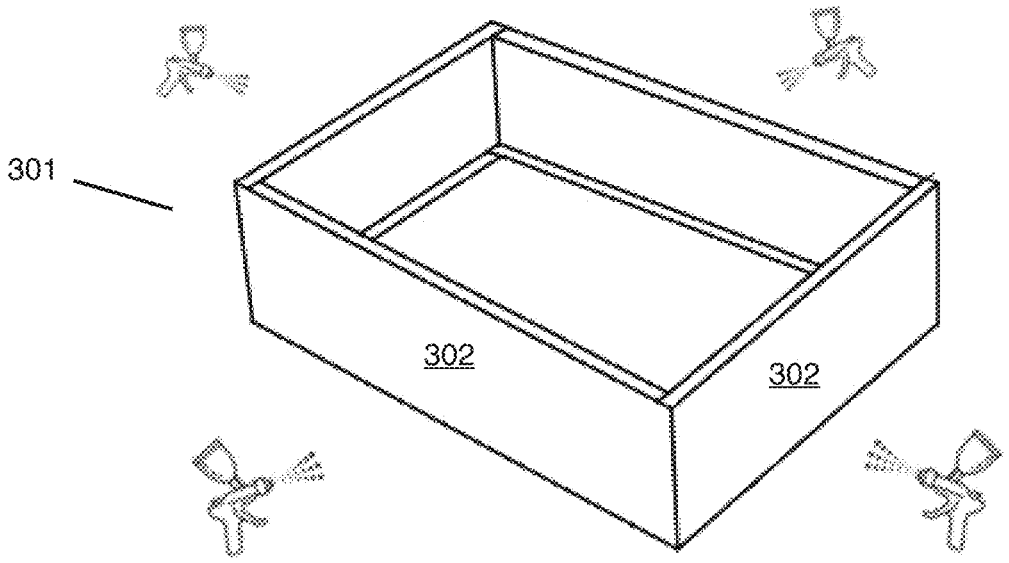
FIG. 40 is a perspective view of a structure before placing the blade assembly of FIGS. 38 and 39 thereon.

In a preferred embodiment, the method of manufacturing the piece of furniture 300, as depicted through FIGS. 38 to 40 and of FIG. 37, comprises the following steps.

A preparation step consists in manufacturing a structure 301 having the before described characteristics.

Another preparation step consists in manufacturing an envelope 322 having the above described characteristics based on the dimensions of the structure.

A following preparation step consists in cutting blades 149 with a length such that the blades 149 can extend, preferably according to the transversal orientation of the piece of furniture, between two adjoining edges 310 of the structure 301.

The following step, depicted on FIG. 38, consists in placing the envelope 322 upside down with the bottom layer 332 on top, and with at least one side panel 327 at least partially hanging, thereby providing access to the open end of the longitudinal sleeves 336, and inserting the blades 149 in the open end 330 of the longitudinal sleeves 336 to obtain a blade assembly 320.

The following step, depicted on FIG. 39, consists in returning the blade assembly 320 upside up with the top layer 334 on top.

The following step, depicted on FIG. 40, consists in applying glue over the structure 301, particularly over at least part of the externally facing faces of the side walls 302 of the structure 301.

The following step consists in placing the support portion 324 upside up, the bottom layer 332 facing down, on the structure 301, letting the side panels 326 hanging, and pressing the side panels 326 over the side walls 302 to adhere the side panels 326 to the structure 301.

Figure 41:
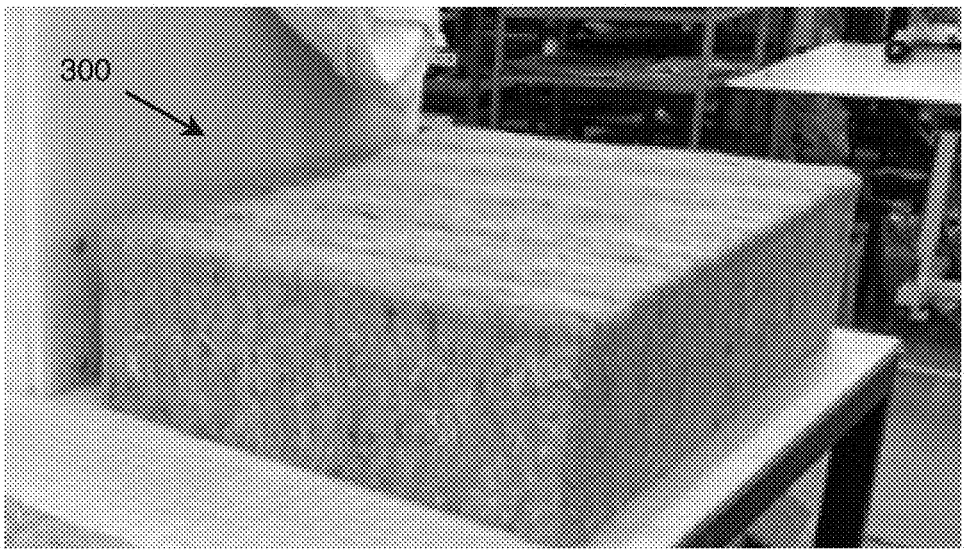
FIG. 41 is a perspective view of a piece of furniture before installing the covering fabric thereon.

FIG. 41 depicts the outcome of these steps. The result is a piece of furniture 300 ready to be applied a covering fabric thereon to become a sofa, a footrest, or another finalized piece of furniture.

Figure 42:
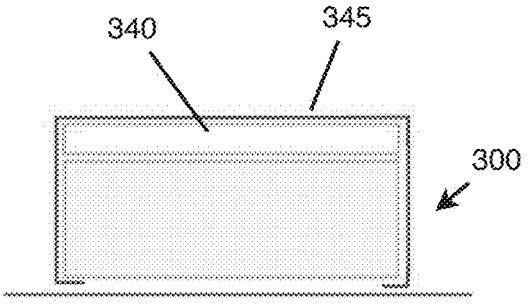
FIG. 42 is an elevated view of a finalized piece of furniture with a cushion enclosed and no leg.
Figure 43:
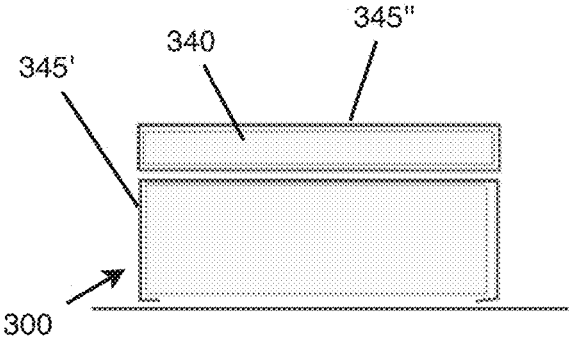
FIG. 43 is an elevated view of a finalized piece of furniture with a separate cushion and no leg.
Figure 44:
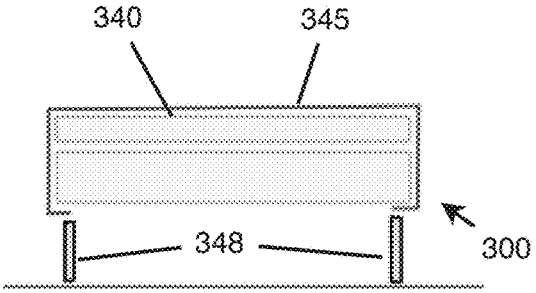
FIG. 44 is an elevated view of a finalized piece of furniture with a cushion enclosed and legs.
Figure 45:
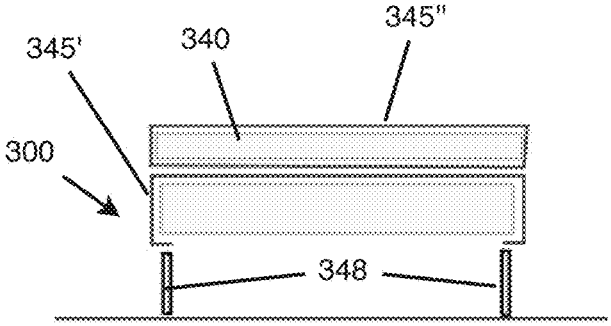
FIG. 45 is an elevated view of a finalized piece of furniture with a separate cushion and legs.

According to embodiments, depicted on FIGS. 42 to 45, transformation of the piece of furniture 300 into a finalized piece of furniture may comprises to put a cushion 340 thereon, with the piece of furniture 300 and the cushion 340 being enclosed into the same covering fabric envelope 345, FIGS. 42 and 44, or in separate covering fabric envelopes 345', 345", FIGS. 43 and 45. The piece of furniture 300 may be designed to sit on the ground, FIGS. 42 and 43, or may be designed for legs 348 to be secured thereto, FIGS. 44 and 45.

Referring back to FIG. 37, it is to be mentioned that this method of using blades 149 provides the designed support for the blades 149, provides a support-free area 314 in which the blades 149 may flex, with a portion of the blades 149 about their ends abutting the top walls 304, and be maintained close to the side walls 302 through resistance exerted by the glued side panels 326 over the edges of the support portion 324 against the edges of the support portion 324 being lifted when the blades 149 are flexing.

It is further to be mentioned that the hindrances offered by the longitudinal sleeves 336 against displacement of the blades 149 ensure that the blades 149 will remain in place over time. The seams between longitudinal sleeves 336 further allows to obtain a surface that is almost fully covered by the bladed 149, and therefore having the blades 149 covering almost the whole surface of the support-free area 314.

Figure 46:
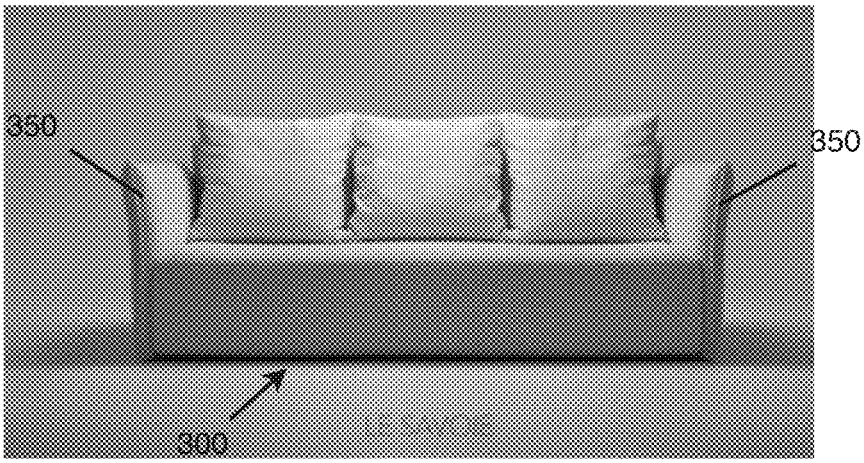
FIG. 46 is a front view of a sofa made with a piece of furniture comprising armrests and no leg in accordance with an embodiment.
Figure 47:
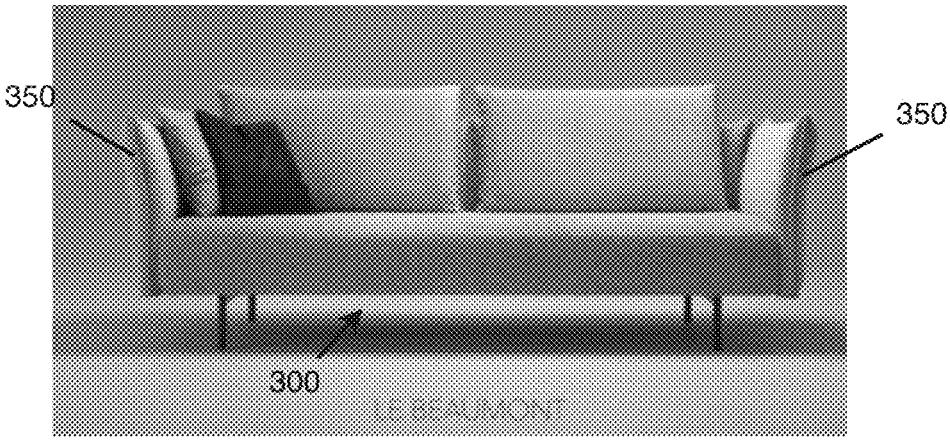
FIG. 47 is a front view of a sofa made with a piece of furniture comprising armrests and legs in accordance with an embodiment.

It is also to be noted, as depicted additionally through FIGS. 46 and 47, that this technique allows, after the installation of the blade assembly 320 on the structure 301, to apply additional padding, or to mount other components thereto. See for example FIGS. 46 and 47 wherein armrests 350 are mounted to the side of the piece of furniture 300 to obtain the depicted sofas. In some embodiments, fittings may be fixed to side walls and a rear wall, with panels of the blade assembly 320 being modified, e.g., with openings for the fittings to extend therethrough, without departing from the scope of the present description.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A piece of furniture comprising:

a structure having side walls with a first distance in-between two of the side walls, and top walls adjoining the side walls; and a blade assembly to cover at least partially the structure, the blade assembly comprising:

an envelope comprising a support portion and side panels, the support portion comprising a top layer having the side panels extending therefrom, a bottom layer, and longitudinal sleeves extending between the top layer and the bottom layer from about a first one of the side panels to about a second one of the side panels, wherein the sleeves have a first length substantially equal to the first distance, the sleeves have an opening, with the longitudinal sleeves being isolated from each other; and blades of about the first length, the blades being inserted in the longitudinal sleeves through the opening;

wherein the blade assembly is mounted to the structure with the bottom layer adjoining the top walls of the structure and the side panels extending over and being secured to the two side walls extending non-parallel to the bottom layer of the structure, with the side panels extending from the top layer non-parallel to the bottom layer closing the openings and thus preventing the blades from exiting the sleeves thereafter, and wherein the side panels of the blade assembly are secured to the side walls of the structure with the side panels maintaining the bottom layer abutting the top walls.

2. The piece of furniture of claim 1, wherein at least one of the side panels is of the same piece of fabric as the top layer.

3. The piece of furniture of claim 1, wherein the top layer and the bottom layer are made of the same type of fabric.

4. The piece of furniture of claim 1, wherein securing means secure the top layer to the bottom layer.

5. The piece of furniture of claim 4, wherein the securing consists of sewing.

6. The piece of furniture of claim 4, wherein the securing means consists in one of stappling, gluing, and fusing.

7. The piece of furniture of claim 1, wherein the bottom layer is wider than the top layer, whereby having longitudinal sleeves domed downward.

8. The piece of furniture of claim 1, wherein a single one of the side panels is secured to the top layer, on an open side of the longitudinal sleeves.

9. The piece of furniture of claim 1, wherein the blades are made of a combination of plastic and fiberglass.

10. The piece of furniture of claim 9, wherein the combination of plastic and fiberglass is extruded together to obtain the blades.

11. The piece of furniture of claim 1, wherein each of the top walls abutted by the blades through the bottom layer has a length of at least 20 mm.

12. The piece of furniture of claim 1, wherein the structure comprises a support-free area extending between the top walls.

13. The piece of furniture of claim 12, wherein the support-free area extends over at least 500 mm.

14. The piece of furniture of claim 12, wherein the support-free area extends over at most 1100 mm.

15. The piece of furniture of claim 1, wherein the blades have ends substantially aligned with each other and parallel to a near junction of the support portion and one of the side panels.

* * * * *